US009132425B2

(12) United States Patent
Wen et al.

(10) Patent No.: US 9,132,425 B2
(45) Date of Patent: Sep. 15, 2015

(54) LIQUID-ELECTRONIC HYBRID DIVIDER

(75) Inventors: Weijia Wen, Hong Kong (CN); Limu Wang, Hong Kong (CN); Xiang Wang, Hong Kong (CN); Shunbo Li, Hong (CN)

(73) Assignee: THE HONG KONG UNIVERSITY OF SCIENCE AND TECHNOLOGY, Hong Kong (CN)

( * ) Notice: Subject to any disclaimer, the term of this patent is extended or adjusted under 35 U.S.C. 154(b) by 419 days.

(21) Appl. No.: 13/639,973

(22) PCT Filed: Apr. 11, 2011

(86) PCT No.: PCT/CN2011/000622

§ 371 (c)(1), (2), (4) Date: Oct. 8, 2012

(87) PCT Pub. No.: WO2011/124092

PCT Pub. Date: Oct. 13, 2011

(65) Prior Publication Data

US 2013/0037149 A1 Feb. 14, 2013

Related U.S. Application Data

(60) Provisional application No. 61/282,850, filed on Apr. 9, 2010.

(51) Int. Cl.
*F15C 1/10* (2006.01)
*B01L 3/00* (2006.01)
(Continued)

(52) U.S. Cl.
CPC ..... *B01L 3/502792* (2013.01); *B01L 3/502784* (2013.01); *F15C 1/003* (2013.01);
(Continued)

(58) Field of Classification Search
CPC ..... F15C 1/02; F15C 1/04; F15C 3/002; F15C 4/00; F15C 7/00; F16K 99/0019; F16K 99/0021; B01L 2400/0421; B01L 2400/0424; B01L 2400/08; G01N 2201/125; G05D 7/0623; G05D 7/069; G05D 29/00; Y10T 29/49405; Y10T 436/143333; Y10T 436/2575; Y10T 137/206; Y10T 137/2065; Y10T 137/2082; Y10T 137/218; Y10T 137/2191
USPC ..... 137/803, 804, 807, 825, 827, 909; 251/129.01
See application file for complete search history.

(56) References Cited

U.S. PATENT DOCUMENTS 6,823,895 B2 * 11/2004 Hitchcock et al. ..... 137/827
6,949,176 B2 * 9/2005 Vacca et al. ..... 204/547
(Continued)

OTHER PUBLICATIONS

Zhao, et al., "Digital Microfluidic Logic Gates and Their Application to Built-in Self-Test of Lab-on-Chip," IEEE Transactions on Biomedical Circuits and Systems, (2010), vol. 4, No. 4, pp. 250-262.
(Continued)

*Primary Examiner* — Craig Schneider
*Assistant Examiner* — Minh Le
(74) *Attorney, Agent, or Firm* — Nath, Goldberg & Meyer; Jerald L. Meyer; Stanley N. Protigal

(57) ABSTRACT

Electronic-fluidic hybrid form dividers, constructed by a simple planer droplet generation structure, a pair of signal electrodes, and a responsive control valve, which is programmed to respond to only certain signal droplets, by a basic electronic principle: change of voltage share between impedances. Detected fluidic information is addressed in both electronic and fluidic forms, and the fluidic pathway is well-confined in a simple planar structure, although its control valve is in a second layer, thereby minimizing any fluidic disturbance. Various configurations comprise a plurality of identical structures, which can alter their cumulative function by re-assignment of required voltage share. The hybrid divider can be assembled into a fluidic universal logic gate, of a simple two inlet and one outlet signal channels structure, and switch between sixteen functions by re-assigning voltage share.

33 Claims, 27 Drawing Sheets

(51) Int. Cl.

| | |
|---|---|
| ***F15C 1/00*** | (2006.01) |
| ***F15C 1/04*** | (2006.01) |
| *B01L 7/00* | (2006.01) |

(52) U.S. Cl.

CPC .. *F15C 1/04* (2013.01); *B01L 7/52* (2013.01); *B01L 2200/143* (2013.01); *B01L 2300/0645* (2013.01); *B01L 2300/0816* (2013.01); *B01L 2400/0427* (2013.01); *B01L 2400/0677* (2013.01); *Y10T 137/206* (2015.04)

(56) References Cited

U.S. PATENT DOCUMENTS

| | | | | |
|---|---|---|---|---|
| 7,640,947 | B2 | 1/2010 | Fernandes et al. | |
| 7,784,495 | B2 * | 8/2010 | Prakash et al. | 137/806 |
| 8,338,166 | B2 * | 12/2012 | Beer et al. | 435/288.3 |
| 8,844,570 | B2 * | 9/2014 | Glick | 137/807 |
| 2006/0037657 | A1 * | 2/2006 | Shibata et al. | 137/827 |
| 2007/0163663 | A1 | 7/2007 | Strand et al. | |
| 2008/0185057 | A1 | 8/2008 | Prakash et al. | |
| 2008/0197882 | A1 * | 8/2008 | Tseng et al. | 326/80 |
| 2009/0235990 | A1 * | 9/2009 | Beer | 137/3 |
| 2010/0089587 | A1 | 4/2010 | Stout | |
| 2010/0151561 | A1 | 6/2010 | Richter et al. | |
| 2011/0018583 | A1 * | 1/2011 | Cassia | 326/80 |
| 2011/0186164 | A1 * | 8/2011 | Glick | 137/803 |
| 2013/0043150 | A1 * | 2/2013 | Ohashi | 206/223 |

OTHER PUBLICATIONS

Chang, et al., "Design and Operation of Microelectrochemical Gates and Integrated Circuits," J. Am. Chem. Soc., (2010), vol. 132, pp. 15404-15409.

Toepke, et al., "Microfluidic logic gates and timers," The Royal Society of Chemistry, (2007), vol. 7, pp. 1449-1453.

Prakash, et al., "Microfluidic Bubble Logic," Science, (2007), vol. 315, pp. 832-835.

Cheow, et al., "Digital microfluidics: Droplet based logic gates," Applied Physics Letters, (2007), vol. 90, pp. 054107-1-054107-3.

Zhao, et al., "Digital Microfluidic Logic Gates," NanoNet 2008, (2009), LNICST 3, pp. 54-60.

* cited by examiner

Truth Table

| $S_1$ $S_0$ | $I_3$ $I_2$ $I_1$ $I_0$ | F | $S_1$ $S_0$ | $I_3$ $I_2$ $I_1$ $I_0$ | F | $S_1$ $S_0$ | $I_3$ $I_2$ $I_1$ $I_0$ | F | $S_1$ $S_0$ | $I_3$ $I_2$ $I_1$ $I_0$ | F |
|---|---|---|---|---|---|---|---|---|---|---|---|
| 0 0 | 0 0 0 0 | 0 | 0 1 | 0 0 0 0 | 0 | 1 0 | 0 0 0 0 | 0 | 1 1 | 0 0 0 0 | 0 |
| | 0 0 0 1 | 1 | | 0 0 0 1 | 0 | | 0 0 0 1 | 0 | | 0 0 0 1 | 0 |
| | 0 0 1 0 | 0 | | 0 0 1 0 | 1 | | 0 0 1 0 | 0 | | 0 0 1 0 | 0 |
| | 0 0 1 1 | 1 | | 0 0 1 1 | 1 | | 0 0 1 1 | 0 | | 0 0 1 1 | 0 |
| | 0 1 0 0 | 0 | | 0 1 0 0 | 0 | | 0 1 0 0 | 1 | | 0 1 0 0 | 0 |
| | 0 1 0 1 | 1 | | 0 1 0 1 | 0 | | 0 1 0 1 | 1 | | 0 1 0 1 | 0 |
| | 0 1 1 0 | 0 | | 0 1 1 0 | 1 | | 0 1 1 0 | 1 | | 0 1 1 0 | 0 |
| | 0 1 1 1 | 1 | | 0 1 1 1 | 1 | | 0 1 1 1 | 1 | | 0 1 1 1 | 0 |
| | 1 0 0 0 | 0 | | 1 0 0 0 | 0 | | 1 0 0 0 | 0 | | 1 0 0 0 | 1 |
| | 1 0 0 1 | 1 | | 1 0 0 1 | 0 | | 1 0 0 1 | 0 | | 1 0 0 1 | 1 |
| | 1 0 1 0 | 0 | | 1 0 1 0 | 1 | | 1 0 1 0 | 0 | | 1 0 1 0 | 1 |
| | 1 0 1 1 | 1 | | 1 0 1 1 | 1 | | 1 0 1 1 | 0 | | 1 0 1 1 | 1 |
| | 1 1 0 0 | 0 | | 1 1 0 0 | 0 | | 1 1 0 0 | 1 | | 1 1 0 0 | 1 |
| | 1 1 0 1 | 1 | | 1 1 0 1 | 0 | | 1 1 0 1 | 1 | | 1 1 0 1 | 1 |
| | 1 1 1 0 | 0 | | 1 1 1 0 | 1 | | 1 1 1 0 | 1 | | 1 1 1 0 | 1 |
| | 1 1 1 1 | 1 | | 1 1 1 1 | 1 | | 1 1 1 1 | 1 | | 1 1 1 1 | 1 |

LIQUID-ELECTRONIC HYBRID DIVIDER

CROSS-REFERENCE

This is a National Phase Application filed under 35 U.S.C. 371 of PCT/CN2011/000622, filed Apr. 11, 2011, and claiming the benefit from U.S. Provisional Application No. 61/282,850, filed Apr. 9, 2010, the content of each of which is hereby incorporated by reference in its entirety.

TECHNICAL FIELD

The present subject matter relates to a fundamental liquid-electronic hybrid rheostat with which a hybrid voltage divider and processor can be derived.

Application of the above components can achieve a liquid-electronic information interface.

BACKGROUND ART

Most popular electronic devices have evolved from the first vacuum tube: the first electronic logic gate. Now there are more than twenty million logic gates functioning in the CPU of any PC. Electronic systems are built by integrating several basic components and several basic modules composed of those components. Logic gates and digital encoders are examples of basic components for electronic systems that perform digital operations, if given one or more logic input(s), and produce a single logic output. For example, given a logic gate having an input of two variables, there are sixteen possible algebraic functions; one simple structure, comprised of four NOR gates, can carry out all sixteen logic operations. Accordingly, this structure is called a universal logic gate (ULG), and it can be used in almost any situation. As a non-limiting example, an ULG can be used for a comparison of frequencies when developing filters in communication, or in more mechanical settings when using choppers and inverters which compare input and output currents to determine modulating indexes. Thus, a controlling system that may be formed with the help of these basic electronic components is needed.

Fluidics are an analog counterpart of electronic computing; for example, water interrogator and other sophisticated fluidic functions were already realized in 1970. Bottlenecks in miniaturization restricted further development of fluidics, resulting in the decline of this computing branch. By using photolithography techniques, especially the soft-lithography technique, fluid channels in sub-millimeter size, even nanometer, are now realized. Accordingly, microfluidic/nanofluidic chips, having a plurality of channels with the size in the range of micrometers or nanometers, are useful as "labs on a chip" and may be used in chemical reaction and biological analysis, including, for new chemical generation, enzymatic analysis, DNA analysis, proteomics, etc. Conventional operations such as sample preparation, pre-treatment and assay detection may be integrated onto a single chip.

Droplet-based microfluidics involves the generation, detection and manipulation (fission, fusion and sorting) of discrete droplets inside micro-devices. Droplets with small volumes can be used for high throughput chemical reaction and single cell manipulation in chemical and biological application. A "lab on a chip" utilizing droplets is a desired apparatus for medical and biological applications, especially for use in Point-of-Care (POC) and "outdoor testing," and particularly in developing countries. Existing conventional equipment has many disadvantages, such as high power consumption, heavy electrical load, and environment dependence, and the "lab on a chip" concept helps address these disadvantages.

Scientists have endeavored to reinvent the near-legendary logic gate component in other systems: some binary logic functions have been successfully mimicked by fluidic diodes, microelectrochemical logic; see for example [NPL 27], and conducting-polymer-coated micro-electrode arrays; see for example [NPL 24]. In microfluidic domains, researchers have scrutinized both kinetic fluid regulation; see for example [NPL 9], [NPL 16], [NPL 19] and static geographical stream manipulation; see for example [NPL 5], [NPL 11], [NPL 14] and [NPL 25] as possible solutions. Simple logic devices such as the AND gate, OR gate, the static fluid transistor and the oscillator are some of the achievements.

Existing devices are problematic in their reliance on complex structures or exterior supporting components. They are limited in that they entail either bulky peripheral equipment for round-trip manipulation, or have complicated 3D microstructures. Moreover, they are confined by the soft-lithographic technique with which they are formed; designed within pre-shaped architectures for distinct tasks, they have no re-programmability or cascadability.

For example, [PTL 1] describes a system containing high or low pressure sources, which includes a pump coupled to a reservoir through unidirectional valves. It may also include devices that perform analog functions such as switching regulator. In [PTL 2], the logic function in fluid is achieved by structure design to change the pressure and thus the flow direction. Similarly, in [PTL 3], devices are based on the principle of minimum energy interfaces formed between the two fluid phases enclosed inside precise channel geometries.

[PTL 4] describes an operating tool that uses programmed fluid logic provided by use of flow paths including pre-determined spaced ports and varying orifice sizes to provide discrete pressures and fluid flow rates upon pressure differential sensitive devices, such as a membrane or piston, in operative communication with an operative sleeve to manipulate one or more secondary tools, and/or to perform a service.

[PTL 5] describes a microfluidic processor with integrated active elements for handling process media, the active elements act by changes in their volume, swelling degree, material composition, their strength and/or viscosity. The procedures to be performed are (pre-)defined by the constructive configuration of the microfluidic processor by an appropriate logic connection of the individual active elements defined in their function, by the sequence of the temporal activation of the individual elements, and with respect to their processing speed and their precision. The process is enabled by action of a substantially non-directional collectively acting environmental parameter, in particular, the presence of a solvent or environmental temperature or both.

In the "lab on a chip" system, the electronic signal is needed for controlling the fluid and biological analysis through a liquid-electronic information interface. In microfluidic chips, high throughput sample screening and information processing may be achieved. As a result, high density control unions, valves, and mixers, are required. Examples of such devices are described in [NPL 9] and [NPL 19]. Despite typically needing supporting off-chip macro-scale solenoid arrays controlled by peripheral equipment, on-chip control components have attracted enormous scrutiny because of their scalability and cascadability.

Discussions of digital microfluidics (DMF) are usually confined to the context of electrowetting-on-dielectric (EWOD) fluid control systems; see for example [NPL 1] and [NPL 8], which is thought to be the most promising technique to realize digital microfluidics; see for example [NPL 17]. Indeed, among proposed on-chip controlling schemes, EWOD, where a computer is used to control droplet movement, is well-known for fine control of "digitalized" droplets. Every single step of droplet movement is well defined, in an electronic approach; see for example [NPL 8], [NPL 13], [NPL 15], [NPL 18]. Despite this, the logic operation is actually conducted by a peripheral computer system, and droplets respond passively to control signals. With EWOD systems, the paradigm for pure fluid/droplet logic, in which the fluid responds only to droplet (fluid) inputs, has somehow been neglected. The fluidic output does not respond to and is not in response to fluidic input, but to computer order. Thus, EWOD's pre-defined round trip control scheme indicates its "electronic" instead of "fluidic" nature, and diminishes its flexibility and application as a true real digitalized microfluidic device akin to a computer.

Other works have been done in pure fluidic logic, for example, geometry decided bubble logic and continuous phase logic; see for example [NPL 22]. The above techniques are usually based on pressure resistance, which results in a specific designed channel configuration for each logic operation, and thus the inevitable amplified perturbation in fluidic system usually occurs. Indeed, previous 'solutions' can be characterized as posing complicated 3D architecture, and require specific designs for each logic function. See citation listing, especially for example, [NPL 14], [NPL 11] and [NPL 25].

3D produces many practical problems in chip-integration. Firstly, three dimensional connections provide fluid turbulence, which generate unexpected drop merge or flow disturbance, leading to message drop-out. Secondly, to realize a real logic processor, all of the logic functions need to be integrated to realize cascading information processes. Technically, a 3D microfluidic channel is not mass-producible: the non-standard logic union structure, non-trivial alignment necessary, unreliable layer bonding, and aforementioned fluidic disturbance all add to the difficulty of making real 3D microfluidic computing devices. As each specific logic function is realized by a specific structure; see for example [NPL 14], [NPL 11] and [NPL 25], a different logic output can only be accomplished by re-assembling various logic components, each time requiring different design(s), another round of fabrication, and dealing with potential fluidic turbulence problems in the new assembled structure. For example, [NPL 28] describes some active logic control, but also requires complex electrode array and extra control of the electrodes, while [NPL 5], [NPL 14] and [NPL 20] are passive control only and dependent on the structure, surface tension and flowrates in their respective microfludic chip(s).

Thus, an active control device instead of the known passive control devices, which rely on pressure difference and structure, is desired.

It is also desired that on-chip droplet control simplify the controlling scheme while preserving the inherent delicacy of micro-devices. It is also desired that the microfluidic computing devices be "smart" enough to "think" by themselves, i.e. the outputs should fully depend on inputs in assigned tasks; see [NPL 7]. Researchers have demonstrated this possibility in both stream regulation method; see [NPL 14], [NPL 11] and [NPL 25], and bubble/droplets schemes; see [NPL 14] and [NPL 5]. Considering the digitalized microfluid, in which picoliter droplets are used as miniaturized reactors, the existence or absence of an "information" droplet can be a very good equivalent of binary 1 or 0. Moreover, the color, volume and component of droplets comprise other dimensions of information. Therefore, droplet-based microfluid logic devices which can self-feedback and can be cascaded to exhibit their own advantages in device-embedded fluidic control and computing are desired.

The following subject matter avoids round-trip fluidic manipulation, while realizing automatic response and logic manipulation and re-programmable hybrid circuitry. It is compatible with existing microfluidic and electronic technology and provides standardized device architecture for large scale integration. In contrast to the PTL references, the instant subject matter provides an active control device, and has a feedback loop for automatic droplet control. Furthermore, the droplet information can also be converted to electric signal for detection and other control. Accordingly, the electric circuit and microfluidic channel are truly combined, with the latter acting as an adjustable part in the circuit.

The automatic droplet logic manipulation discussed herein is realized by a "hybrid divider" structure to employ droplet(s) as a hybrid electronic component for actuator control. The hybrid divider can be a fundamental liquid-electronic hybrid rheostat, a hybrid voltage divider and related hybrid processor. It may be understood as a fluidic diode realized by voltage divider in fluidic form, with transferable circuit principles and the simplest architecture or structure to date. By introducing the hybrid divider, a new branch of fully automatic droplet logic control has been invented: the droplet logic gate. The traditional round-trip computer command controlling valves or droplets (in EWOD) is replaced by reprogrammable fluidic framework, and the fluidic output fully depends on the input, thereby realizing droplet-controlled microfluidic logic (on-chip droplet control); see for example [NPL 23]. Existing fluidic logic gate technologies contain distinct chip shape(s) for each specific logic function, limiting their applications. Fluidic channels could not be rearranged to realize another function in the same chip. Instead, another chip must be fabricated for the task, i.e. ten chips for ten tasks. In contrast, the hybrid divider discussed herein is reprogrammable by voltage, i.e. one chip/processor for every task, like a fluidic CPU.

Introduction of droplet(s) to electronic circuit(s), or conversely, introduction of electronic switch(es)/actuator(s) as a component of fluidic circuitry is described for various combinations and applications. Thus, fast and automatic logic control of droplet(s) is achieved. Furthermore, real problems can be solved by integration of the fluidic hybrid diode as described: as a fluidic processor programmed by voltage signal and responsive to fluidic input, i.e. its fluidic output depends on its fluidic input.

SUMMARY

In accordance with a first aspect, a hybrid divider or rheostat is provided. The hybrid divider or rheostat comprises a channel conveying carrier fluid and droplets, the carrier fluid having a first dielectric constant or conductivity and the droplets having a second dielectric constant or conductivity. The hybrid divider or rheostat further comprises two voltage adjustable input terminals substitutable by electronic circuit(s), an electronic component or channel comprising a pair of electrodes and carrier fluid in the channel, an output signal circuit; a controlling component or feedback component and a first conductor electrically connecting the second electrode with the impedance. The electronic component or channel comprises an impedance selected from the group consisting of resistor, inductance and capacitor. The controlling component or feedback component has a first end connected to the output signal, and a second end connected to a controllable device selected from the group consisting of a pump and a valve. The pair of electrodes are opposing electrodes, about the carrier fluid in the channel.

In accordance with another aspect, a hybrid switch comprises the hybrid divider and an actuator. The presence of a droplet between the pair of electrodes turns on the actuator.

In accordance with other aspects, a droplet storage system is provided, comprising the hybrid divider and a long channel comprising a microchannel embeddable pump.

In accordance with certain other aspects a device controller is provided comprising a plurality of hybrid dividers connected in parallel, such that parallel output signals of the hybrid dividers control a device.

In accordance with another aspect, an integrated processor is provided. The integrated processor comprises a plurality of hybrid dividers connected in series and parallel to achieve multipurpose tasks.

In accordance with another aspect, an apparatus comprising a plurality of hybrid dividers connected in series is provided, where the input signal of at least one hybrid divider is selected from the group consisting of the output signal of the preceding hybrid divider or other power supplies.

In accordance with other aspects, an apparatus comprising one or more of the hybrid dividers is provided, where the one or more hybrid divider is configured to act as a hybrid copier, hybrid computer, encoder, decoder, multiplexer, or other logic device.

In accordance with another aspect, a droplet generation module comprising a hybrid divider is provided, where the components and or channels are fabricated on a plurality of layers of a chip, and where the chip layer geometry is capable of triggering and releasing electric and fluidic signals and flow of at least voltage and fluid.

In accordance with other aspects, a droplet detection system is provided comprising a hybrid divider.

In accordance with other aspects, a droplet reaction system is provided comprising a plurality of hybrid dividers and a droplet merge module.

In accordance with certain other aspects a droplet reaction system is provided comprising a plurality of hybrid dividers connected in parallel, such that parallel output signals of the hybrid dividers control a device.

In accordance with another aspect, a hybrid rheostat/divider is provided comprising fluid channel means comprising means for conveying carrier fluid and droplets. The hybrid rheostat/divider also comprises voltage input means having voltage adjustable input means substitutable by electronic circuit(s) and electronic component means or electrode means operable with the carrier fluid in the fluid channel means to provide an impedance selected from the group consisting of resistor, inductance and capacitor. The hybrid rheostat/divider further comprises control or feedback means responsive to the impedance, and having a fluid control output, where at least two of the electrode means form opposing electrodes about the carrier fluid in the channel.

DESCRIPTION OF EMBODIMENTS

Figure 1:
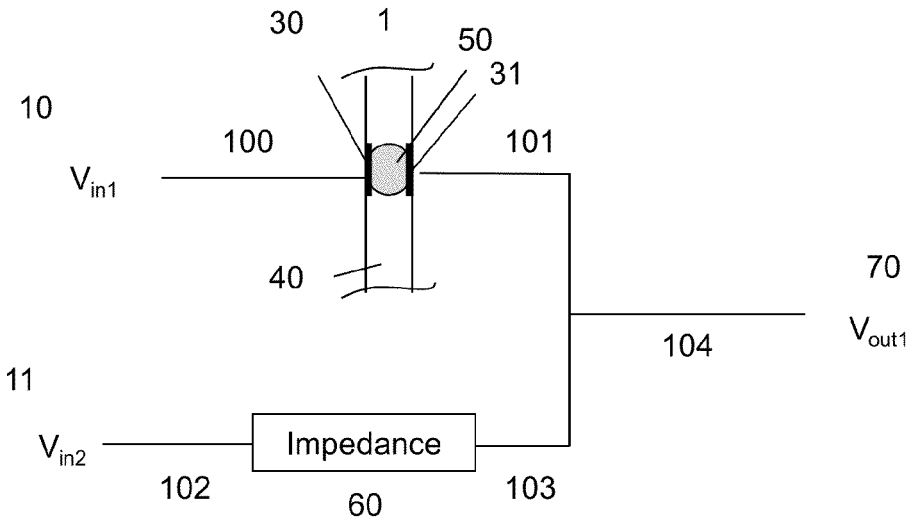
FIG. 1 is a schematic diagram of a hybrid divider for fluid integrated logic operation.

The instant device is an arithmetic logic component for self-subsistent microfluidic computing tasks. The device utilizes random/modulated droplet signal(s) as inputs for on/off switch of an embedded air valve, to control the droplet input of a second hybrid logic device, with exactly the same structure. The logic protocol among cascaded devices can be preprogrammed by input voltage arrangement, thereof, to realize an automatic scheme for droplet arithmetic. Peripheral equipments and preset round-trip manipulation were minimized to its least possible quantity, therefore greatly simplifying the controlling scheme, while providing more functionality of a shaped-hybrid system by re-programmability.

The present subject matter proposes a structure named hybrid divider, a structure that maintains the form of a voltage divider, which targets fast detection and precise manipulation of fluid, preferably microfluidic/nanofluidic droplets. The input signals of the hybrid divider are both electric and fluidic, while the output can also be in both forms. The fluidic signal output can be stored or displayed in a fluidic channel, which may be controlled by a connected valve. The voltage output signal can either be continuous or discrete in value, which can be decided according to different applications. The continuous output can be used in sensing characters of different fluid/droplets and control information processing components, while the discrete signals can be control signals for actuators or pumps, or to realize digitalized information processing. Therefore, effective integration of the subject matter is a way to digitalize fluidic information, as well as to realize basic hybrid logic functions, such as switch, logic gate, encoder, decoder, and multiplexer; such basic functions are prerequisites for achieving the final goal of fluidic computing or hybrid computing.

One aspect of the present subject matter is a hybrid voltage divider for electric and fluidic signal processing. A voltage divider (also known as a potential divider) is a simple linear circuit that produces an output voltage ($V_{out}$) that is a fraction of its input voltage ($V_{in}$). Voltage division refers to the partitioning of a voltage among the components of the divider. In the instant hybrid divider, a multiphase fluid in a fluidic channel is employed as one impedance component. The fluidic channel comprises two opposite electrodes embedded on the channel sidewall, which serve as detectors of fluidic characteristics, such as size, dielectric characteristics, etc. In one example, a hybrid divider consists of one impedance component, one fluid channel with two opposite electrodes embedded on the channel side wall, and several conductors (such as conducting wires or carbon-conductive polydimethylsiloxane, or CPDMS, composite) which serve to link voltage input and output. A first channel conveys a carrier fluid having a first dielectric constant or conductivity and droplets of a second fluid having a second dielectric constant or conductivity in the carrier fluid. The presence or absence of a droplet in the first channel, especially between a pair of electrodes of the first channel, serves as an impedance to modulate the shared voltage between the electrodes, while providing digital information; e.g. a (1) corresponds to a droplet being present and a (0) corresponds to a droplet not being present at that moment in time. By adjusting the droplet or the electronic components including input signal, impedance desired voltage signal(s) can be obtained. The obtained voltage signal may also be provided for other needed circuits. If complicated hybrid logic processing is needed, several units of hybrid dividers can be integrated on one chip to realize a specified function. Furthermore, fluidic logic processors, which can fulfill the desire of multipurpose hybrid information processing, may be realized by integrating numerous hybrid dividers.

A further aspect of the present subject matter is that the impedance can be specified as four particular groups of voltage share components, such as resistors, inductors, capacitors, and fluidic impedance. Suitable devices are chosen according to aimed functions and the electrical property of fluid in processing. For example, conductive epoxy, electromagnetic coils and dielectric materials can be used as resistors, inductors and capacitors, respectively, in the hybrid computing microfluid/nanofluid chip. The component can even be specified as another channel containing fluid with suitable dielectric or electric properties.

The described techniques may provide apparatus such that the voltage sharing components can both be commercialized electronic devices and liquid phase material with proper dielectric properties. For example, electrorheological fluids (ERF), which are dielectric smart materials, can replace commercialized capacitor(s) to fulfill the function of impedance. Smart materials such as magnetorheological fluids (MRF), thermal-tunable materials, CPDMS composite, ionic fluids, etc. can also serve as components of this hybrid divider.

Another aspect of the subject matter is that the output voltage signal can either be continuous or discrete in value. Based on the voltage partition nature of a hybrid divider, the output voltage can be tuned by the input signal(s), droplet characteristics, value of impedance(s), connection method of impedance(s), number of impedance(s), and many other related functions. In an example of a hybrid divider which comprises a fluidic impedance, the factors such as the number of impedances, connection between impedances and input voltage for impedances are set, i.e. with a certain value and arrangement. Droplets of different fluids with different conductivity/dielectric constants dispersed in an insulated fluid are caused to flow in the fluidic impedance. The value of the fluidic impedance therefore varies when droplets of different fluid are presented between a pair of detecting electrodes, and the voltage output of the hybrid divider therefore varies. Several values of voltage output may be obtained, as input signals of further electric/fluidic information processing. In another example, a threshold output voltage (such as actuate voltage of an actuator) is defined such that: voltage larger than the threshold value is defined as TRUE(1), and voltage lower than that threshold is defined as FALSE(0). Thus digitalized, and even binary, information processing by the hybrid divider can be achieved.

Yet another aspect of the present subject matter is that a microfluid/nanofluid channel is incorporated in this design to provide fluidic signal input for hybrid logic processing. In one non-limiting example, the apparatus according to this aspect of the present subject matter may have a channel for conveying a carrier fluid having a first dielectric constant or conductivity and droplets of a second fluid having a second dielectric constant or conductivity in the carrier fluid, and an impedance, such as a resistor. The presence or absence of the droplet between a pair of opposite electrodes in a first channel conveys an electrical potential to an electrode connected to the impedance, and will change the voltage distribution in the hybrid divider. In this way the potential drop across the first channel, when a droplet is present, is different from the potential drop when no droplet is present between the electrodes. For example, if the droplet of second fluid has a higher conductivity than the carrier fluid, then the potential drop across the first channel will be less when a droplet is present between the electrodes. The remaining potential drop is across the resistor, the resistance of which is comparable but larger than the resistance of the droplet. Thus when a droplet is present between the electrodes, the majority of the potential drop is across the resistor, and the output voltage of the hybrid divider is therefore decreased.

In one perceived embodiment, an ionic droplet is adopted in the first fluidic channel and the corresponding impedance is a resistor that is comparable with the resistance of the ionic droplet. By way of a non-limiting example, the components may be connected in series to form the fluidics analog of a resistive divider. The resistance in the fluidic channel conveys a carrier fluid having a first dielectric constant or conductivity and droplets of the ionic fluid. The presence or absence of a droplet in the resistor fluid channel, especially between a pair of electrodes, provides digitalized fluid information, e.g. a (1) corresponds to a droplet being present and a (0) corresponds to a droplet not being present at that moment in time. Then the output voltage of the hybrid rheostat/divider will be changed depending on the presence or absence of a droplet.

The apparatus according to yet another aspect of the present subject matter may have a module for generating and controlling the droplets and/or carrier fluid. The module can be controlled by a microfluidic valve system and/or flow focusing structures, etc. The apparatus may also comprise a voltage source for applying a voltage to the module. The apparatus may also comprise a source of carrier fluid of a first fluid and a source of droplets of a second fluid, the second fluid having a different dielectric constant or conductivity than the first fluid. The sources may, for example, comprise pumps or containers for containing the fluid. The apparatus preferably further comprises an output, storage, and/or display channels for the generated/utilized fluidic information.

A further aspect of the present subject matter is that the logic operation of the hybrid divider can be carried out only by droplet signal, while the input signals remain unchanged. Traditionally what had been described as fluidic logic comprised active control (manually or by computer) of signal(s), and fluid/droplets only responded passively for the control signal. In contrast, the present subject matter realizes a real fluidic logic operation, in which once the logic function of the hybrid divider (or integrated hybrid divider) is determined, the logic is actively carried on by fluid.

The method of the further aspect may use the presence or absence of droplet as an ON/OFF switch signal for a desired hybrid logic operation, while the input voltage signals for the hybrid divider remain unchanged. Alternatively, the output voltage may be tuned by droplets with different conductivity/dielectric constant value(s) in the first channel, and the voltage inputs for the hybrid divider are constant.

Another aspect of the present subject matter is that the output signal can be used for multiple purposes. For example, the information of the fluid can be extracted by an electronic sensor which is connected via the output wire. The flow information such as velocity, temperature, droplet length and so on can be obtained. As another example, the output signal may be used to control another circuit or control the fluid flow in a microfluid/nanofluid channel. In an exemplary embodiment, the hybrid divider can be used to realize digitalized/hybrid information processing, such as hybrid switch. In another example, a hybrid divider comprises a first channel in which an ionic droplet is carried by an isolative fluid, and a resistor whose resistance is the same as that of the ionic droplet. The hybrid divider is connected with an electric actuator from its voltage output side. The presence or absence of the ionic droplet between a pair of electrodes in the fluidic channel influences the output voltage of the hybrid divider, changes the voltage difference across the actuator, and therefore changes the ON/OFF state of the actuator. A hybrid switch is therefore realized. In another exemplary embodiment, this structure can be applied to control the droplet flowing in different channels when it goes to the crossroads. This can be achieved by connecting the output signal to a pump or valve which can generate or stop the fluid flow.

Components to be controlled with respect to the apparatus according to a further aspect of the present subject matter can be electric components, such as micro pumps and micro valves, or smart materials, such as electrorheological fluids (ERF), magnetorheological fluids (MRF), thermal-tunable materials, etc.

A circuit may be arranged to apply another voltage input of the connected component, to provide an electric potential difference across the component. The circuit can be a module or another hybrid divider.

An additional aspect of the present subject matter is a build block which can be assembled/integrated to form any desired logic operation to realize as a so-called hybrid processor to process either electrical or flow signals or both. The hybrid divider is a basic unit for hybrid information processing system. The combination of two of them can easily form a universal logic gate which carries 16 basic logic gates. The 16 basic logic gates may be configured by detailed design of the input voltage signals and the materials in the channel. In a further example, output signals of two hybrid resistor dividers are inputs of an actuator, having an actuate voltage of 5 v. To realize the logic gate XOR, two inputs on the resistor side are grounded, and two inputs on the fluid channel side are connected to a 10 v power supply. The actuator will be at ON state once a droplet is present between electrodes in either channel of the two fluid channels, and will be at OFF state when there is no droplet present or two droplets simultaneously present between the pairs or electrodes of the two channels. A total of sixteen logic gate operations can be comprised in a similar principle by rearranging the input voltage signal. Preferably the control droplets in the first and second fluid channels are conductive, e.g. formed of a highly ionized solution.

The apparatus of the above aspects is the hybrid dividers, which can be connected in serial or in parallel to realize hybrid information processing/computing. The serial connection can accomplish many steps in different situations, for example, utilizing output of a hybrid divider as input of another hybrid divider; in the parallel connection the hybrid dividers can simultaneously yet independently process information. A hybrid logic processor may even be formed by combination of series connection and parallel connection to form a complete connection with liquid channels and impedances. In this regard, a hybrid divider is just like an integrated circuit in the electronic system, which can accomplish any complex task. Thus, any component formed by hybrid divider can be regarded as a unit which may be reconstructed to any desired structure for expected functionality.

Another additional aspect of the present subject matter is a feedback component added to realize an Analog-to-Digital or Digital-to-Analog (AD/DA) converter. In the microfluidic/nanofluidic system, many factors are useful, e.g. the chemical composition, the kinetics of the droplet, the concentration of a chemical, the color of the fluid, the temperature of the fluid, the optical properties of the fluid etc. In another example, the output signal is connected to the droplet generator of the subsequent unit. If the length of an ionic droplet is large, and its carrier fluid is insulated, the output voltage can remain high for a long time. Then the droplet generator can generate more or longer droplets, according to the designed function of the generator; otherwise, it will generate fewer/shorter droplets.

Yet another additional aspect of the present subject matter is to realize integrated hybrid computing, in which the hybrid dividers can be either integrated in one chip by appropriate arrangement, or separated in different microfluidic chips while maintaining connection via conductive wires in an appropriate way. In an additional example, two hybrid dividers can be integrated in one chip with very limited distance to realize a hybrid universal logic gate, or two input sides of an actuator can be connected with outputs of two hybrid dividers individually by conducting wires, while the two microfluidic circuits are in two physically separate chips.

As discussed above, related techniques for realization of microfluidic control in microfluidic chips are numerous. Through improvements made to ERF effects and the development of soft conducting composites, researchers have been able to integrate those techniques with microfluidics in order to digitalize droplets of nano to pico liter size and achieve, therefrom, droplet logic/storage/display modules.

This hybrid divider is a treble-function fluidic information process unit: droplet sensor, actuator, and media access (e.g for computer). The realized microfluidic mixer, storage, display, and droplet phase modulator functionalities are all compatible with the hybrid divider discussed herein. For example, a highly integrated DNA-amplifying microfluidic chip may be realized by employing related technology. In the near future, simple combinations of IF/NOT micro-droplet logics could lead to microfluidic processors, analogs to micro-electronic computers. To take the concept one step further, integration of all of the techniques described above might lead to a hybird computing system. Moreover, the components of this suggested system all have chip-embedded electrodes, which can serve as information interfaces with electronic devices, promising a highly integrated system comprised of PCs and microfluidic processors.

Inevitably, the processing capability of this logic device (fluidic response on the order of 10 ms) will be compared with that of PCs (electronic processes' response of nanoseconds). The delay can be meliorated by adjusting the flow speed and flow-focusing geometry, but not eliminated. Despite this, microfluidics and electronics deal with different issues: microfluidics is not expected to become mainframe computing systems but rather are earmarked for exploratory, LOC research and POC applications (e.g. portable diagnosis kits), areas in which conventional computers has their own intrinsic shortcomings. The future of microfluidics lies not in computing but in multi-dimensional information processing. Microfluidics in any case retains its inherent promise: its extension of the fluidic information realm beyond "binary 0/1" to the spatial, chromatic or physiologic dimension; see for example [NPL 6], [NPL 10], [NPL 18], [NPL 26]. Preloaded chemical or biological information can be well preserved in droplet form. Droplet polymerase chain reaction (PCR), for example, can easily store and recreate genetic information; see for example [NPL 3]. Microfluidics provides a unique tool for handling and processing biological, chemical, environmental, genetic and chromatic information. Considering the contribution of DNA logic to fuzzy computing; see for example [NPL 2], [NPL 4], which indeed can be elaborated in picoliter droplet, it is really difficult to foresee a limited future of microfluidics if tools like DNA computing are incorporated.

The hybrid divider described herein facilitates a microfluidic processor, performing important control and memory operations on the basis of droplet trains. Nonlinear chemical dynamics, complex neuron communication, or DNA computing might be carried out on every droplet of this processor, and these droplets could couple together for more complex tasks. Electromagnetic technology extended the human sensory system, by which we sense the world by a portable device. Through microfluidic technology, a living part (blood, tissue, cell or DNA, etc.) is extended to micro-chips, and beyond. The hybrid divider-assisted microfluidic technology may combine the extended "human body" and "human sensory system" on a piece of microfluidic chip, in a fully automatic sense. The coupled system may realize infinite practical, industrial and research outcomes.

According to the above aspects and configurations, the present device provides a digitized unit which can simultaneously process input information in both electric signal and fluidic signal form, and also output information in both of electrical and fluidic signal forms. These kind of processing components are defined as hybrid digital components; the processing unit maintains the form of a voltage divider, and is therefore referred to as a hybrid divider. The hybrid divider can be a basic processing unit which can be used to create larger-scale integrations to perform all kinds of digital operations between electric fluidic signals, such as fluidic encoder and multiplexer. By incorporating feedback and an active control system, the hybrid divider can be used to realize fluidic or hybrid computing, within a portable size and inexpensive form.

The apparatus can be provided either on one microfluidic/nanofluidic chip or several separated microfluidic/nanofluidic chips which are interconnected in a suitable way. The chip and channel walls may be fabricated from polydimethylsiloxane (PDMS) or any other suitable material. Where electrodes are referred to in the following description they can be provided adjacent the channel walls, or embedded into the channel walls. The channels can be less than 500 μm in width and diameter. The actuator blocks in the drawing always represent a hybrid actuate circuit, which may comprise impedances, fluidic channels, and commercialized actuators.

Example 1

FIG. 1 is a schematic diagram of a hybrid divider for fluid integrated logic operation. The arrangement is configured to act as a single and independent unit "hybrid divider." The first fluidic channel 1 acts as a fluidic signal channel and conveys a carrier fluid 40 having a first dielectric constant or conductivity and droplets of a second fluid 50 in the carrier fluid. The first fluidic channel 1 can either be a single fluidic channel or a droplet generation and storage/display module.

The droplets act as 'control droplets' and the second fluid 50 has a second dielectric constant or conductivity. Preferably, the second dielectric constant or conductivity is higher than the respective first dielectric constant or conductivity value.

The first channel 1 has a first electrode 31 on a first side thereof and an opposing second electrode 32 on the opposite side of the channel facing the first electrode 31. The first conductor 100 connects the first electrode 31 to a power supply $V_{in1}$, indicated at 10. The conductors 100-104 can either be integrated into the microfluidic/nanofluidic chip (e.g. as a conducting strip of AgPDMS) or as a conducting line external to the microfluidic chip (e.g. an electrical wire outside of the chip connecting the two electrodes inside the chip). The impedance can be a resistor, inductor or capacitor and it is connected to a second power supply $V_{in2}$, indicated at 11, by conductor 102. The potential difference thus has a path through the channel 1 when conductive/dielectric fluid is passing between the two opposing electrodes 30 and 31. In an electronic system, this simple structure forms a voltage divider, the relationship between the input voltage, $V_{in1}$-$V_{in2}$, and the output voltage, $V_{out1}$, indicated at 70, can be described as $$V_{out1} = \frac{Z_2}{Z_1 + Z_2}(V_{in1} - V_{in2}),$$

providing $Z_2$ is the impedance value of the droplet 50 between the electrodes 30 and 31, $Z_1$ is the impedance value of electronic component 60. The dielectric constant or conductivity of the droplets 50 is higher than the dielectric constant or conductivity of the carrier fluid 40. Therefore the potential drop across the channel 1 varies depending on whether or not a droplet 50 is between the first 30 and second 31 electrodes of the channel. When a droplet 50 is between the first and second electrodes, then the potential drop in the first channel 1 is low and there is a relatively large potential drop across the impedance. However, when only carrier fluid (i.e. no droplet) is between the first 30 and second 31 electrodes, the potential drop across the channel 1 is relatively high. The potential drop across the impedance is then lower and not enough to reach the threshold potential.

Figure 2:
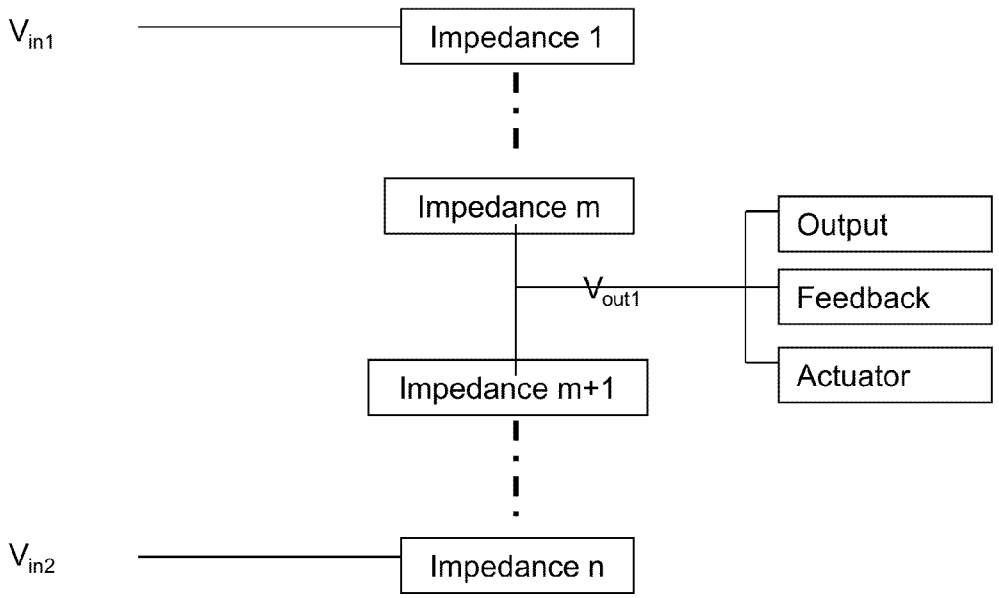
FIG. 2 is a schematic diagram of a hybrid divider as an example for integrating more impedance.

FIG. 2 is a schematic diagram of a hybrid divider as an example for integrating more impedance. In this arrangement, more variable configurations may be applied to the hybrid divider since more impedances are introduced, facilitating an increased number of input/output voltage combinations, etc. This hybrid divider can be applied to achieve precise adjustment of the output signal. The impedances used can be resistors, inductances, capacitors and/or droplets between two electrodes. The configuration may be generalized so that the impedance(s) are connected to any kind of circuit and the output signal can be picked up at any ends of the wire.

Example 2

Figure 3:
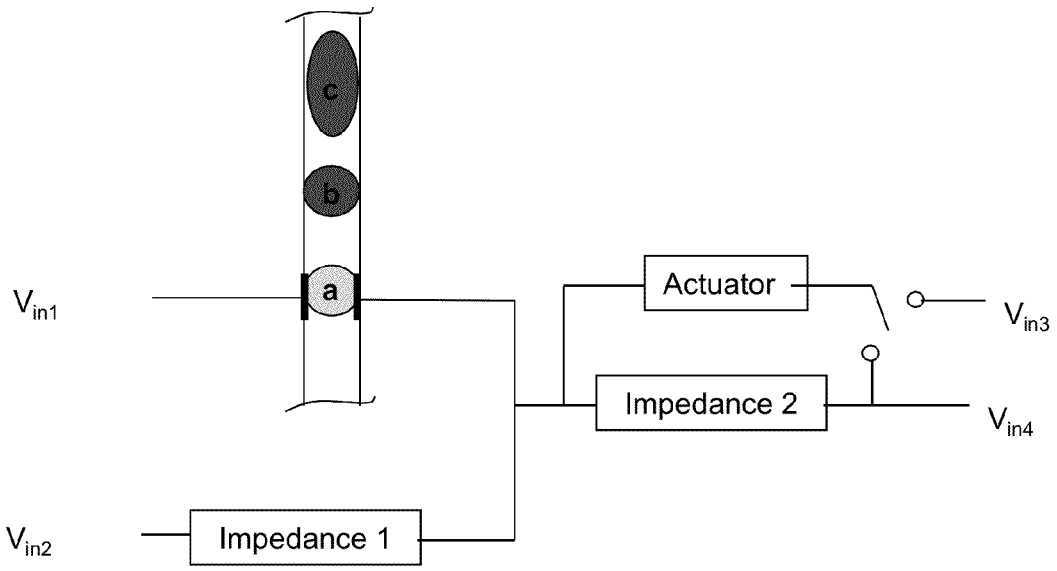
FIG. 3 is a schematic diagram of a hybrid divider that can be applied to deal with continuous information.

FIG. 3 is a schematic diagram of a hybrid divider that can be applied to deal with continuous information. The configuration is similar to FIG. 1. Two adjustable inputs are added at one side of the actuator, while another end of the actuator is connected to the output of the hybrid divider. The actuator is sensitive to continuous change of the voltage. In one example, the actuator is a pump, the channel in the hybrid divider has three types of ionic droplets which have different conductivity and volume, Impedance 1 and Impedance 2 are both resistors having the same resistance, and the actuator is switched to input 4, which is grounded. Since droplet a and droplet b have different conductivity, the output voltages of the hybrid divider are different when the droplets are present between two electrodes. The fluid flow is also different, due to the different input voltage of the pump. Since droplet b and droplet c have different volumes, the effective working time of the pump is different. Thus, it is concluded that the bigger the volume of the ionic droplet, the longer the working time.

The results of one experimental setup are presented in Table 1. The input voltages were 9V, 0V and 0V for $V_{in1}$, $V_{in2}$, $V_{in4}$, respectively. While the droplet volume was on the scale of nanoliters in this experiment, different volumes, such as droplet volumes in the picoliter range, may also be used; the working time under similar conditions may maintain the ratio of t, t and 2t, respectively.

TABLE 1

Experimental outcome

| Impedance 1 | Impedance 2 | Droplet conductivity | Droplet resistance | Droplet volume | Output voltage | Working time |
|---|---|---|---|---|---|---|
| 100 Ω | 100 Ω | Σ | 100 Ω | 1 nL | 3 v | 50 ms |
| 100 Ω | 100 Ω | 3 σ | 33.3 Ω | 1 nL | 1.8 v | 50 ms |
| 100 Ω | 100 Ω | 3 σ | 33.3 Ω | 2 nL | 1.8 v | 100 ms |

Figure 4:
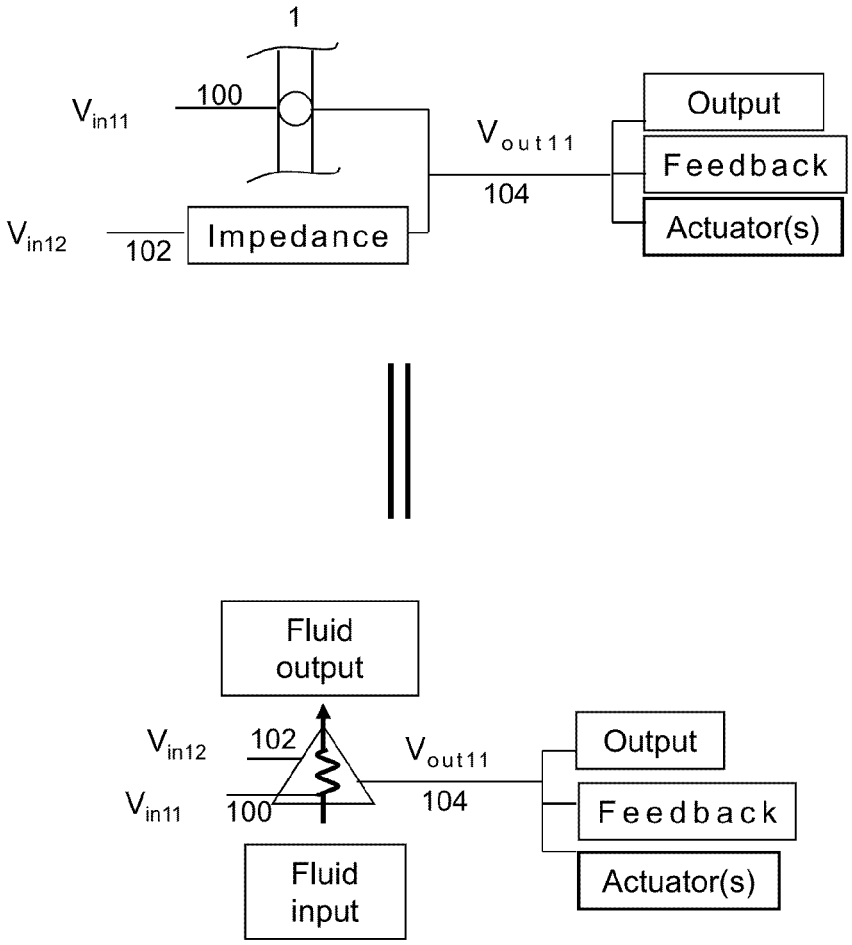
FIG. 4 is a defined equivalent symbol for a hybrid divider.

FIG. 4 is a schematic diagram of the hybrid divider with a defined symbolic diagram for the hybrid divider. A triangle symbol is employed to represent the macro structure of a hybrid divider, while most of the detailed structure is concealed. A voltage input $V_{in11}$ is connected to a first fluidic channel 1 through a first conductor 100, and a second voltage input $V_{in12}$ is connected to the impedance inside the hybrid divider through a second conductor 102. The fluidic pathway, represented by the first fluid channel 1, is represented by an arrow across the middle of a triangle. Fluidic output is carried out by the first fluidic channel while electric output $V_{out11}$ is carried out by a third conductive line 104. The output signal, feedback signal, and control signal of connected actuators can be obtained through conductive line 104.

Example 3

Figure 5:
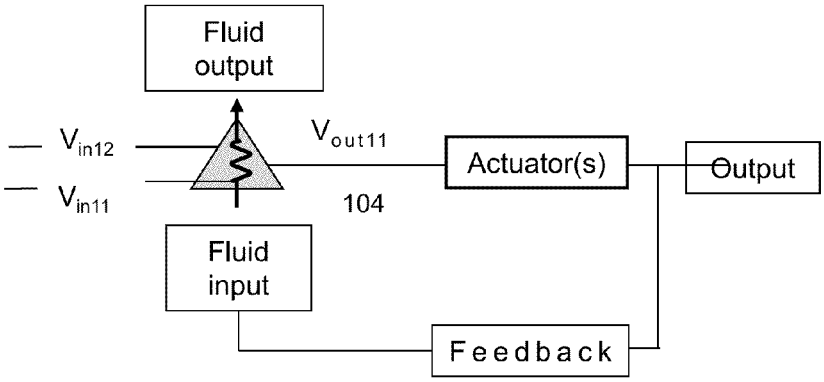
FIG. 5 is a schematic diagram of a hybrid switch mainly composed by a hybrid divider and an actuator which responds to the output voltage of the hybrid divider.
Figure 6:
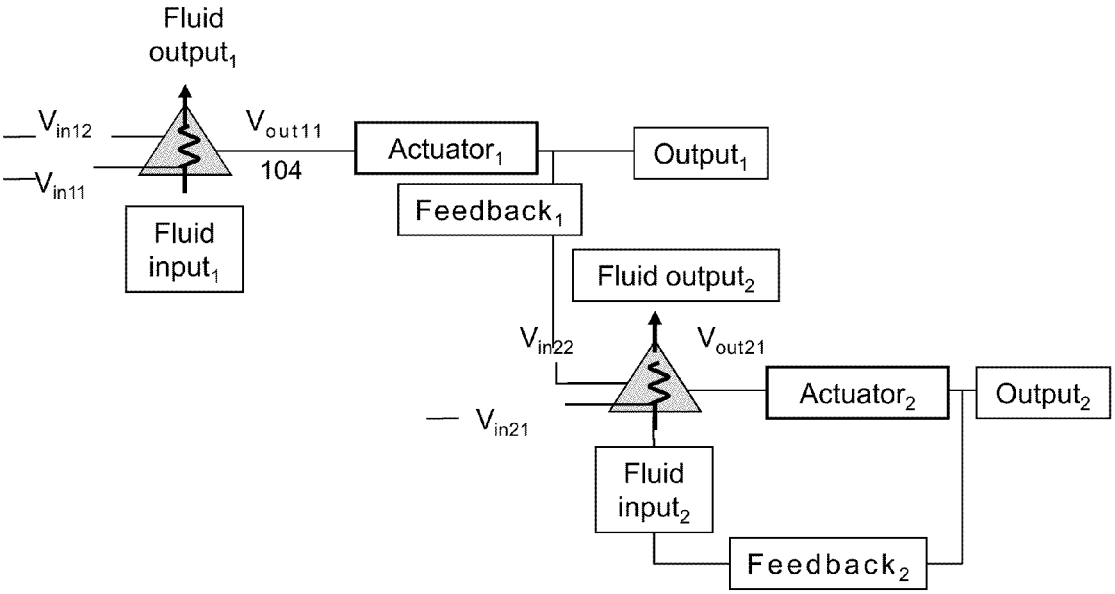
FIG. 6 is a schematic diagram of a cascaded hybrid switch mainly composed by two hybrid dividers as in FIG. 5, the second actuator (second hybrid switch) responding to the output voltage of the first hybrid divider.
Figure 7:
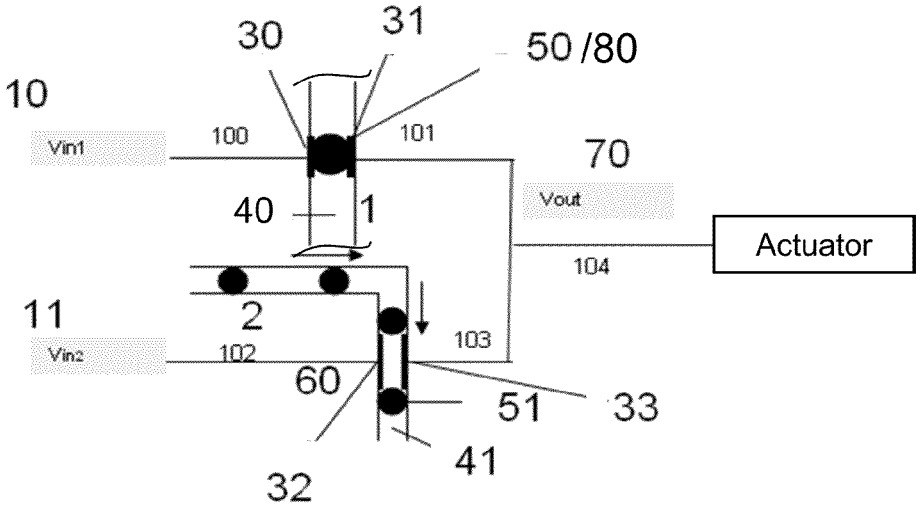
FIG. 7 is an example of a hybrid switch.

FIGS. 5, 6 and 7 show arrangements for a hybrid switch, composed mainly of a hybrid divider and an actuator which responds to the output voltage of the hybrid divider.

FIG. 5 is a symbolic diagram for the switch, where an actuator/actuators is/are connected to the hybrid switch via a conductor 104, such that the output voltage $V_{out11}$ of the hybrid divider determines whether or not the actuator(s) is/are activated.

FIG. 6 is a symbolic diagram for another of many possible configurations of the switch, where an actuator/actuators is/are connected to the hybrid switch via a conductor 104, such that the output voltage $V_{out11}$ of the hybrid divider determines whether or not the $Actuator_1$ is activated, and also drives $V_{in22}$ of a second hybrid divider.

Alternatively, for example for a third switch, the input voltages could be derived from $Feedback_1$ and $Feedback_2$ of preceding hybrid divider circuits.

FIG. 7 is a schematic diagram of a specific example of the hybrid switch. First and second channels 1, 2, are connected by conductors 101, 103, and first, second, third and fourth electrodes 30, 31, 32, 33. The second channel 2 contains carrier fluid 41 and droplet 51, similar to that described with respect to FIG. 1. The second channel 2 has the second carrier fluid 41, the second type of droplet 51 and the third electrode 32 on a first side thereof and an opposing fourth electrode 33 on the second side. The input voltage $V_{in2}$ may be set to 10 v and input voltage $V_{in1}$ grounded, while the actuate voltage of the connected actuator is 5 v. An impedance, preferably a first resistor 80 with the same resistance as a droplet of the fluid droplet 50, is connected to the circuit by first conductor 100 and 101 through electrodes 30 and 31. In a specific example, the first resistor 80 can be a droplet of a third fluid 50 dispersed in a fourth insulate fluid 40. When the droplet of the second channel 2 is present between two opposed electrodes 32, 33, the output voltage is 5V, thus the actuator is in the working state and this state is defined as the ON state of this hybrid switch. On the other hand, when carrier flow 41 in channel 2 is present between two electrodes 32, 33, the output voltage is 0V, as a result the actuator is in stationary state, and this is defined as OFF state of this hybrid switch. Therefore, an ON/OFF hybrid switch can be achieved by the hybrid divider and its connected actuator.

The hybrid divider having impedance mainly composed of fluidic channels can also be used to model AND gate(s), if all droplets used are conductive or highly dielectric.

Example 4

Figure 8:
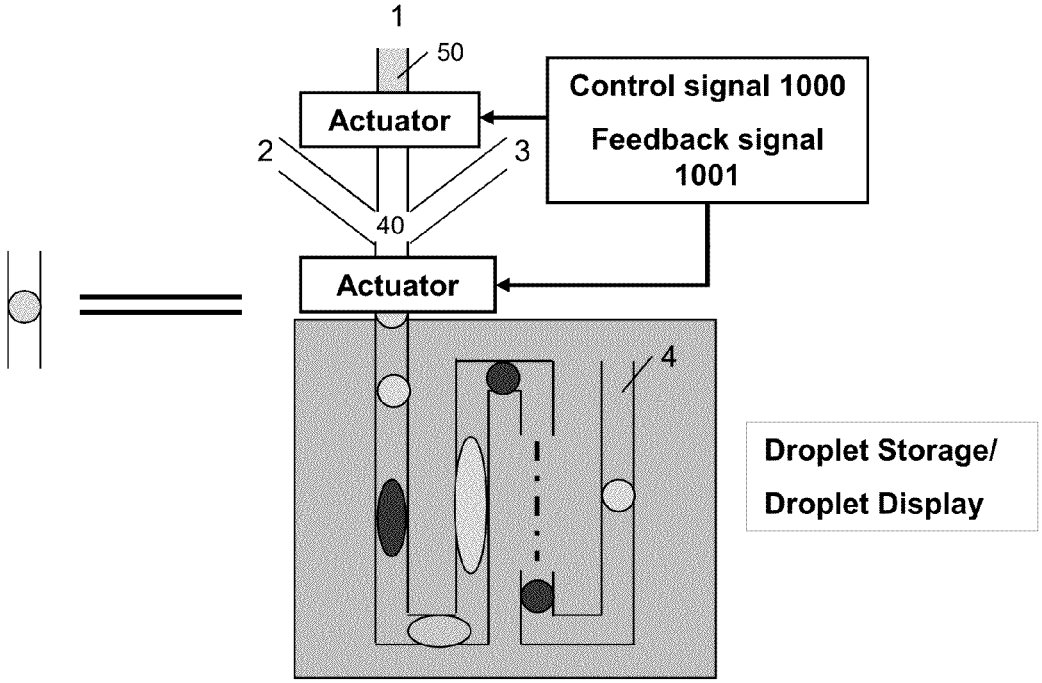
FIG. 8 is a schematic diagram of droplet generation and storage/display module.

FIG. 8 is a schematic diagram of a droplet generation and storage/display module. The configuration of the droplet generation and storage module consists of flow focusing channels 1, 2, 3, a droplet storage channel 4, and a controlling component to control droplet generation and output. The controlling components used may be generic, such as a pump, valve or simply a metallic wire, and do not have to be specially designed or modified. Contemplated non-limiting examples of valves include solenoid valves, such as described in [NPL 29], fluidic valves, such as described in [NPL 25], air valves, such as described in [NPL 21], or electrorheological (ER) valves, such as described in [NPL 12], among others.

A first fluid 50, having a first conductivity/dielectric constant, flows in channel 1, and a second (carrier) fluid 40, having a second conductivity/dielectric constant, flows in the second and third channels 2 and 3. The control signal 1000 and feedback signal 1001 can be applied to control the valve in the flow focusing channels. While the valve is controlled to open, it can generate droplets and vice versa. The droplets in storage channel 4 can be applied to display the color information of the droplet, or they may be pumped out to be the input signal for the next unit. The module can be simple or complex; FIG. 7 shows a simplified model. The module can made more complex by adding more channels containing carrier or dispersed fluid, and more valves to achieve droplet generation and output according to desired function, or the module can be made simpler by deducting undesired component such as channels and valves to realize a function.

Figure 9:
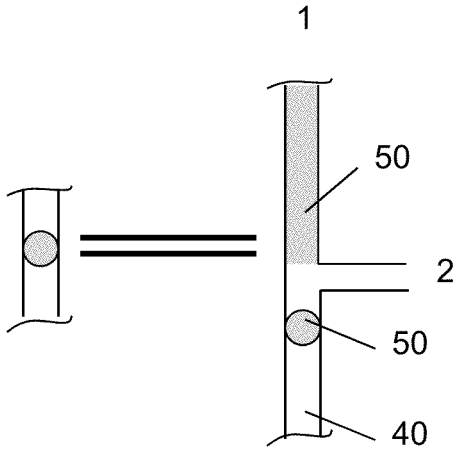
FIG. 9 is a schematic diagram showing a simple example of the droplet generation and storage/display module.

FIG. 9 is a simplified example of the above droplet generation and storage/display module. The first fluid flowing in channel 1 is fluid 50 with a first conductivity/dielectric constant, and the second fluid in second and third channels 2 is carrier flow fluid 40 with a second conductivity/dielectric constant. A droplet of fluid 50 is formed near the illustrated T junction in diagram, where fluid 50 is interrupted by fluid 40 in the junction.

Example 5

Next, with reference to FIGS. 10 and 11, an example 5 of configuration of the hybrid dividers will be described. In the following description, only portions different from the hybrid divider of the example 1 will be described.

Figure 10:
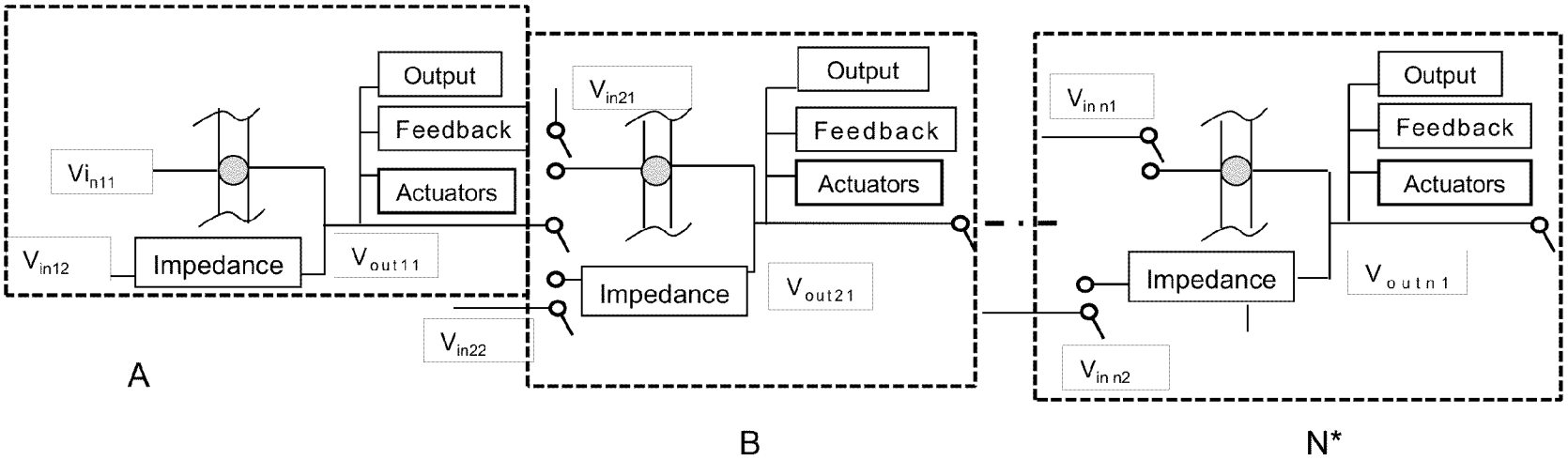
FIG. 10 is a schematic diagram of a structure constructed by connecting hybrid dividers in serial, which can be applied to complex logic processing of hybrid signals.

FIG. 10 is a schematic diagram of a structure constructed by connecting hybrid dividers in serial, which can be applied to complex logic processing of hybrid signals. The input signal of a subsequent hybrid divider B is the output signal from a previous hybrid divider A, and this pattern can be infinitely repeated to an end hybrid divider N* to realize a desired hybrid information processing function.

Figure 11:
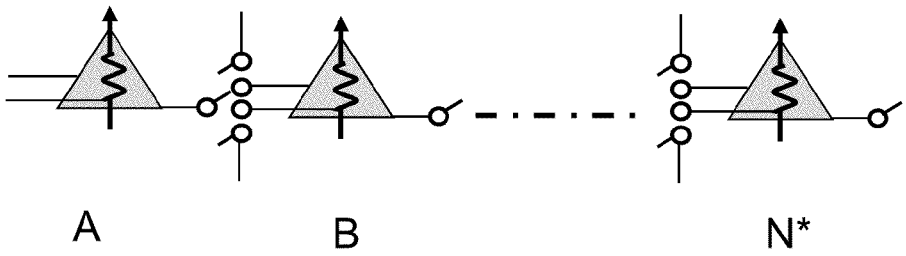
FIG. 11 is a symbolic diagram of the serial connection of hybrid dividers to realize complex logic processing.

FIG. 11 is a symbolic diagram of the serial connection of hybrid dividers to realize complex logic processing, where the hybrid dividers A, B, N* are connected in a serial manner, as described with respect to FIG. 10.

Example 6

Next, with reference to FIGS. 12 and 13, an example 6 of configuration of the hybrid dividers will be described.

Figure 12:
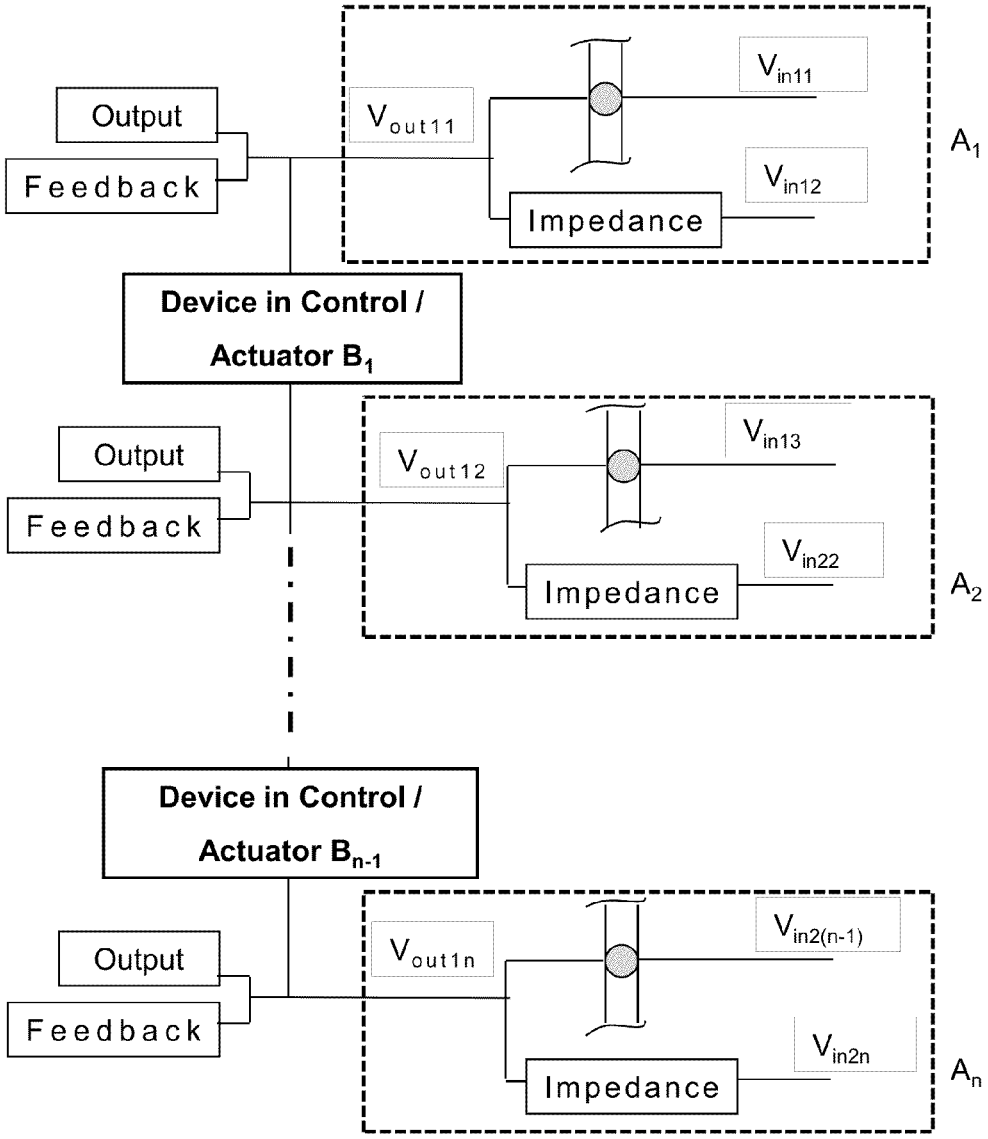
FIG. 12 is a schematic diagram of a structure constructed by connecting hybrid dividers in parallel, which can be applied to complex logic processing of hybrid signals.

FIG. 12 is a schematic diagram of a structure constructed by connecting hybrid dividers in parallel, which can be applied to complex logic processing of hybrid signals. A first hybrid divider $A_1$ and a second hybrid divider $A_2$ can process information individually with independent input, and their output signals $V_{out11}$ and $V_{out12}$ are two separate inputs of a first device $B_1$ in control, preferably an actuator, to control the ON/OFF state or other working state of the actuator. An output signal of the parallel configuration can be utilized to control an infinite number of devices, and an infinite number of hybrid dividers, such as n hybrid dividers, can be connected in parallel to control n−1 devices, where a hybrid divider is configured to control 2 actuators. Thus, an nth hybrid divider $A_n$ and its immediately preceding hybrid divider $A_{n-1}$ can process information individually with independent input, and their output signals $V_{out1n}$ and $V_{out1(n-1)}$ would be two separate inputs of the (n−1)th device in control $B_{n-1}$, preferably an actuator, to control the ON/OFF state or other working state of the actuator.

Figure 13:
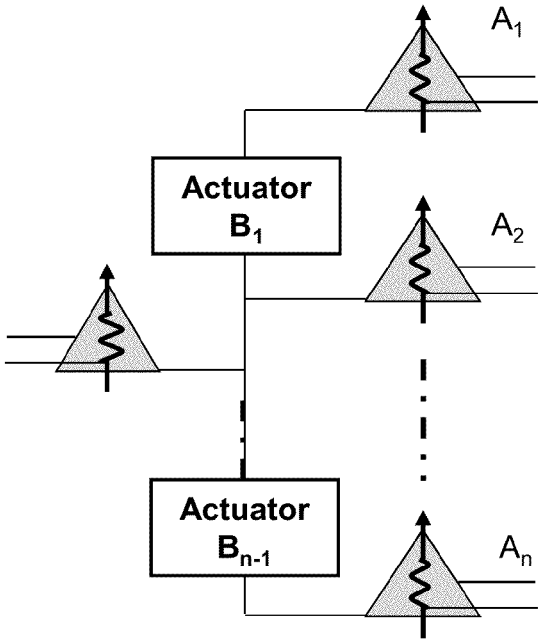
FIG. 13 is a symbolic diagram of the parallel connection of hybrid dividers to realize complex logic processing.

FIG. 13 is a symbolic diagram of the parallel connection of hybrid dividers to realize complex logic processing, where the hybrid dividers $A_1$, $A_2$, etc. to $A_n$ are connected in a parallel manner, as described with respect to FIG. 12 to control devices or actuators $B_1$ to $B_{n-1}$.

Example 7

Next, with reference to FIGS. 14 and 15, description will be given of an example 7 in the case where two sets of hybrid dividers are used to form a hybrid universal logic gate.

Figure 14:
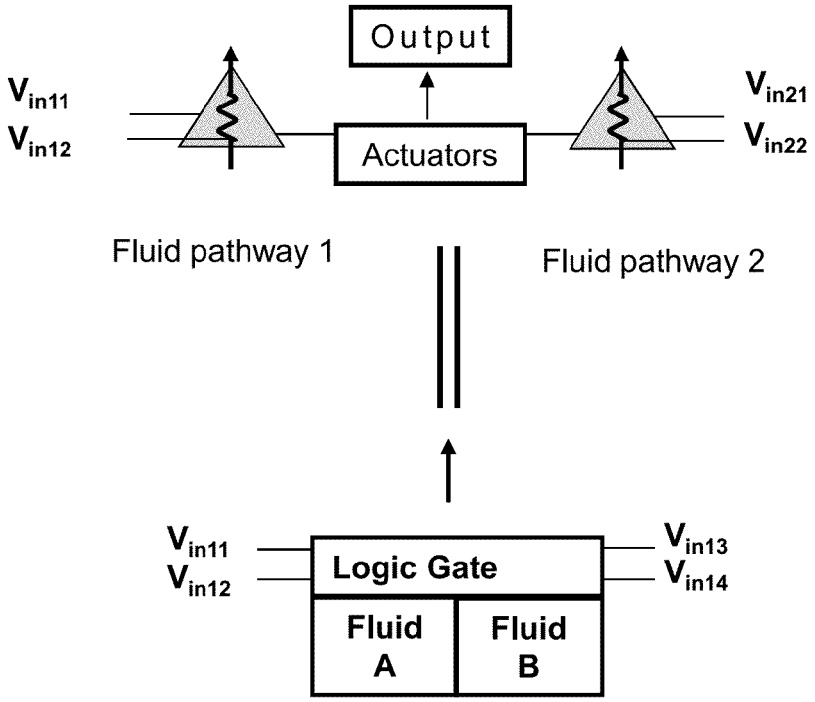
FIG. 14A is a symbolic diagram of an equivalent circuit of the hybrid universal logic gate of FIG. 14, in which experimental data was obtained for various logic functions.

FIG. 14 is a symbolic diagram of a hybrid universal logic gate, which is a simple example of parallel connection of two hybrid dividers, and also defines an equivalent symbol of a hybrid universal logic gate. A first voltage output $V_{oUT11}$ and a second voltage output $V_{out12}$ from a first hybrid divider $A_1$ and a second hybrid divider $A_2$ are employed to control a first hybrid actuate circuit $B_1$. Preferably, the hybrid actuate circuit $B_1$ may comprise a commercialized actuator and an impedance in parallel with the actuator. The impedance preferably has a value comparable to impedances of the hybrid dividers. By configuring four independent voltage inputs of the two hybrid dividers $A_1$ and $A_2$, sixteen total logic operations can be realized. These logic operations are: FALSE, A AND B, A≠>B, A, A<≠B, B, A XOR B, A OR B, A NOR B, A XNOR B, NOT B, A<=B, NOT A, A=>B, A NAND B, and TRUE.

FIG. 14 also defines a simplified symbol to represent a hybrid universal logic gate. Fluid A and Fluid B represent means for fluidic input signal, while $V_{in11}$, $V_{in12}$, $V_{in13}$ and $V_{in14}$ are four independent input voltages which define the logic operation of the logic gate. The term "logic gate" can be replaced by the name of any logic gate, such as the name of any logic gate of the 16 logic operations once a desired operation is decided by the 4 independent voltage input. An arrow pointing upwards represents digital output information, which is usually in the form of voltage or working state of a device such as ON/OFF of an actuator. The detailed structure is purposely concealed to give prominence to principle structures.

Using the hybrid universal logic gate of FIG. 14, the following experimental data was obtained for various logic functions. A magnetic valve was used as a switch or "switcher," although any voltage sensitive actuator may be substituted for the magnetic valve, or any valves discussed herein. The gate voltage was 6 v.

Figure 14A:
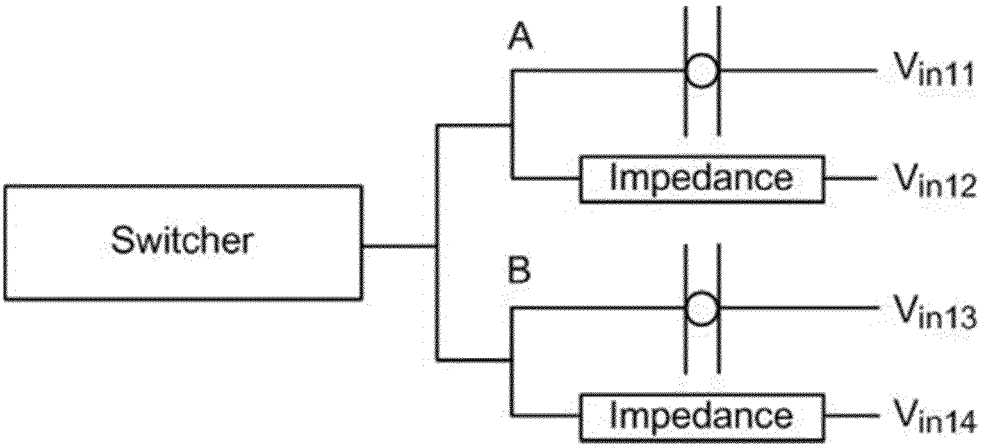

FIG. 14A is a symbolic diagram of an equivalent circuit of the hybrid universal logic gate of FIG. 14, in which experimental data was obtained for various logic functions, as depicted in Tables 3-8.

Table 3 shows the experimental data equivalent to an AND function. The voltage input was 5 v and −5 v for $V_{in11}$, $V_{in12}$ and $V_{in13}$, $V_{in14}$, respectively. The voltage difference between the fluidic channels when there is a droplet and there is no droplet is 2 v and 3.6 v, respectively, or a total voltage difference of ~5 v.

TABLE 3

A AND B truth table.

| A | B | ΔV | Output | Definition |
|---|---|---|---|---|
| 0 | 0 | 2.8 v | 0 | 0 |
| 0 | 1 | 4.4 v | 0 | 0 |
| 1 | 0 | −4.4 v | 0 | 0 |
| 1 | 1 | 6 v | 1 | 1 |

Table 4 shows the experimental data equivalent to a NAND function. The voltage input was 8 v and −8 v for $V_{in11}$, $V_{in12}$ and $V_{in13}$, $V_{in14}$, respectively. The voltage difference between the fluidic channels when there is a droplet and there is no droplet is 3 v and 7.6 v, respectively, or a total voltage difference of ~10 v.

TABLE 4

A NAND B truth table.

| A | B | ΔV | Output | Definition |
|---|---|---|---|---|
| 0 | 0 | 12.6 v | 1 | 1 |
| 0 | 1 | 8 v | 1 | 1 |
| 1 | 0 | −8 v | 1 | 1 |
| 1 | 1 | 3.4 v | 0 | 0 |

Table 5 shows the experimental data equivalent to an OR function. The voltage input was 8 v and −8 v for $V_{in11}$, $V_{in12}$ and $V_{in13}$, $V_{in14}$, respectively. The voltage difference between the fluidic channels when there is a droplet and there is no droplet is 3 v and 7.6 v, respectively, or a total voltage difference of ~10 v.

TABLE 5

A OR B truth table.

| A | B | ΔV | Output | Definition |
|---|---|---|---|---|
| 0 | 0 | 3.4 v | 0 | 0 |
| 0 | 1 | 8 v | 1 | 1 |
| 1 | 0 | −8 v | 1 | 1 |
| 1 | 1 | 12.6 v | 1 | 1 |

Table 6 shows the experimental data equivalent to an XOR function. The voltage input was 15 v and 15 v for $V_{in11}$, $V_{in12}$ and $V_{in13}$, $V_{in14}$, respectively. The voltage difference between the fluidic channels when there is a droplet and there is no droplet is 2.6 v and 9.5 v, respectively, or a total voltage difference of ~13 v.

TABLE 6

A XOR B truth table.

| A | B | ΔV | Output | Definition |
|---|---|---|---|---|
| 0 | 0 | 0 v | 0 | 0 |
| 0 | 1 | 7 v | 1 | 1 |
| 1 | 0 | 7 v | 1 | 1 |
| 1 | 1 | 0 v | 0 | 0 |

Table 7 shows the experimental data equivalent to an NOR function. The voltage input was 5 v and −5 v for $V_{in11}$, $V_{in12}$ and $V_{in13}$, $V_{in14}$, respectively. The voltage difference between the fluidic channels when there is a droplet and there is no droplet is 2 v and 3.6 v, respectively, or a total voltage difference of ~5 v.

TABLE 7

A NOR B truth table.

| A | B | ΔV | Output | Definition |
|---|---|---|---|---|
| 0 | 0 | 7.2 v | 1 | 1 |
| 0 | 1 | 5.6 v | 0 | 0 |
| 1 | 0 | −5.6 v | 0 | 0 |
| 1 | 1 | 4 v | 0 | 0 |

Table 8 shows the experimental data equivalent to an XNOR function. The voltage input was 8 v, −5 v, −5 v and 8 v for $V_{in11}$, $V_{in12}$ and $V_{in13}$, $V_{in14}$, respectively. The voltage difference between the fluidic channels when there is a droplet and there is no droplet is 3 v and 11 v, respectively, or a total voltage difference of ~15 v.

TABLE 8

A XNOR B truth table.

| A | B | ΔV | Output | Definition |
|---|---|---|---|---|
| 0 | 0 | 7.8 v | 1 | 1 |
| 0 | 1 | 0.9 v | 0 | 0 |
| 1 | 0 | 0.9 v | 0 | 0 |
| 1 | 1 | −7 v | 1 | 1 |

Figure 15:
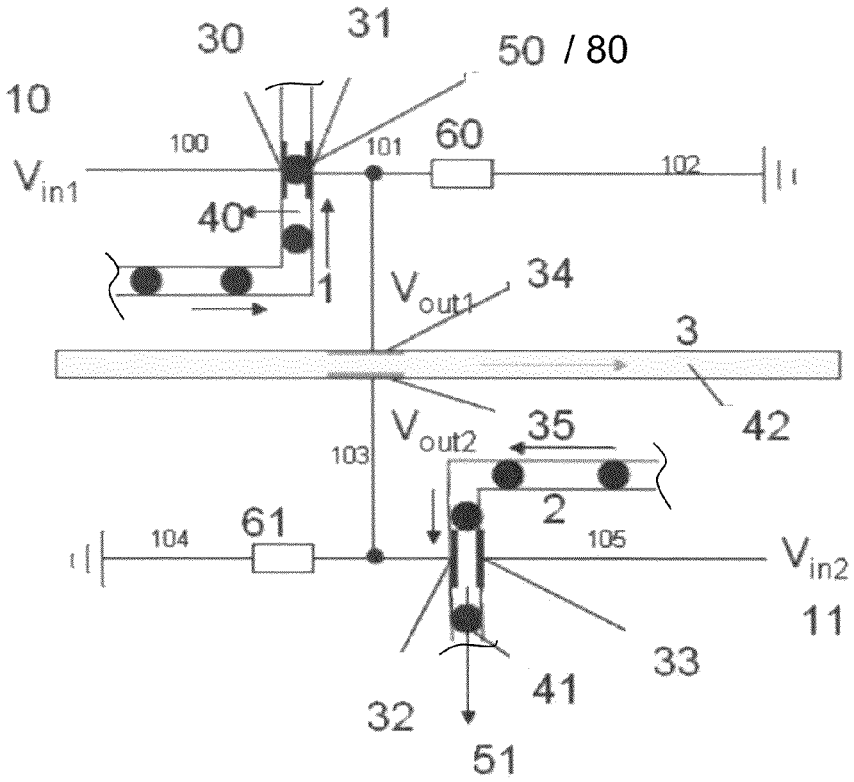
FIG. 15 is a specific example of the universal logic gate, utilizing two hybrid resistor dividers to realize hybrid universal logic gate.

FIG. 15 is a schematic diagram of a specific example of the hybrid universal logic gate, which is composed of two hybrid resistor dividers. In this specific example, the two output sides of both dividers are input signals for an actuator, specifically an ERF actuator. The voltage potential of the second electrode 31 is conveyed to the fifth electrode 34 by a second conductor 101, and the voltage potential of the third electrode 32 is conveyed to the sixth electrode 35 by a fourth conductor 103. In the first fluidic channel, when a droplet of a first fluid 50 with a first conductivity/dielectric constant is dispersed in a fluid 40 with a second conductivity/dielectric constant passed by the first and second opposed electrodes 30 and 31, the voltage output $V_{out1}$ is therefore changed as a result of changed voltage division across opposed electrodes 30 and 31.

In the second fluidic channel, when a droplet of a third fluid 51 with a third conductivity/dielectric constant dispersed in a fluid 41 with a fourth conductivity/dielectric constant passed by the third and fourth opposed electrodes 32 and 33, the voltage output $V_{out2}$ is therefore changed as a result of the changed voltage division across opposed electrodes 32 and 33. In another example, the component connected between the opposed fifth and sixth electrodes 34 and 35 is an impedance (a third impedance) paralleled actuator, the actuate voltage of which is 5 v. Preferably the first, second and the third impedances 60, 61 and 62 are of the same value, which is very large compared with that of the actuator, while the first and third fluids 50 and 51 are conductive, the resistance of which can be neglected, and the second and fourth fluid 40 and 41 are insulate. Taking XOR as an example, two input signals 10, 11 are connected to a 10 v power supply, and two other input signals 12, 13 are grounded. Therefore the voltage difference across the third impendence may be 5 v, which is the actuate voltage of the actuator, either when a droplet of the first fluid 50 is passing by the opposed electrodes 30 and 31 in channel 1, or a droplet of the third fluid 51 is passing by the opposed electrodes 32 and 33 in the second fluid channel 2. However, when the droplets of the two fluids 50 and 51 are simultaneously present or absent between the opposed electrodes 30, 31 and 32, 33, respectively, the voltage across the fifth and sixth electrodes 34 and 35 is 0 v, which is not enough voltage for the actuator to work. Therefore a binary output defined by the working state of the actuator is decided by the position of droplets of fluids 50 and 51.

Thus, if fluid 50 is defined as input A, and fluid 51 is defined as input B, while the presence of a droplet of fluid 50 or 51 between a pair of electrodes in channel 1 or channel 2 is defined as input 1, and the absence of fluid 50 or 51 between the electrodes is defined as input 0, the truth table may be as shown in Table 9.

TABLE 9

A XOR B truth table.

| A | B | Δ V | State of actuator | Definition |
|---|---|---|---|---|
| 0 | 0 | 0 v | 0 | 0 |
| 0 | 1 | 5 v | 1 | 1 |
| 1 | 0 | 5 v | 1 | 1 |
| 1 | 1 | 0 v | 0 | 0 |

In another example the impedance paralleled actuator is replaced by a third channel 3 containing flowing ERF 42 and the threshold voltage of solidification of ERF is 200 v. The value of impedance 60 and 61 is preferably chosen to be the same as that of ERF between the fifth and sixth electrodes 34 and 35. The voltage inputs $V_{in1}$ and $V_{in2}$ are set to be 400 v, while the third conductor 102 and the fifth conductor 105 are grounded. Therefore, the voltage difference across the fifth and sixth electrodes 34 and 35 may be 200 v, which is the solidifying voltage of ERF in the third channel, either when a droplet of the first fluid 50 is passing by the opposed electrodes 30 and 31 in channel 1, or when a droplet of the third fluid 51 is passing by the opposed electrodes 32 and 33 in the second fluid channel 2. When the droplets of two fluids 50 and 51 are present or absent simultaneously between the opposed electrodes 30, 31 and 32, 33, respectively, the voltage across the fifth and sixth electrodes 34 and 35 is 0 v, and the ERF will keep flowing.

Thus, if the solidified state of ERF is defined to be TRUE (1), and the flowing state of ER Fluid is defined to be FALSE (0), and the presence of a droplet between a pair of electrodes is defined to be TRUE (1), and the absence of a droplet between desired electrodes is defined to be FALSE (0), the truth table of the ERF logic gate may be as shown in Table 10.

TABLE 10

A XOR B truth table for ERF experiment

| A | B | Δ V | ER state |
|---|---|---|---|
| 0 | 0 | 0 v | flowing |
| 0 | 1 | 200 v | solidified |
| 1 | 0 | 200 v | solidified |
| 1 | 1 | 0 v | flowing |

While the above experiment was conducted using ERF, the use of MRF or other electro-responsive fluids or materials is contemplated to achieve similar results for other desired logic gate(s), such as XOR, etc. Therefore, a hybrid universal logic gate can be built using the hybrid dividers through different configurations, using varied components.

Example 8

Figure 16:
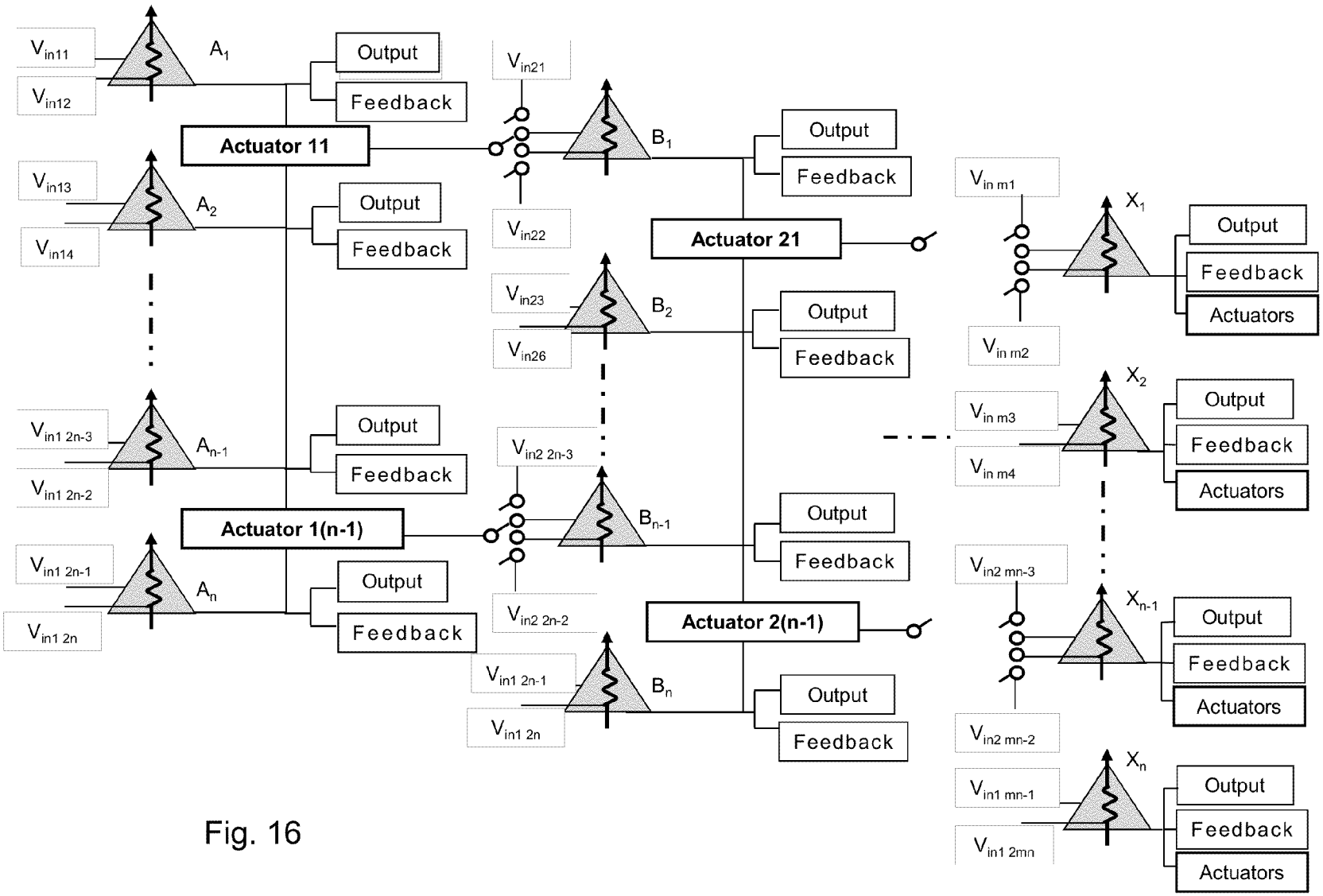
FIG. 16 is a schematic diagram of an integrated hybrid processor, which purposely connects numerous hybrid dividers in parallel and serial simultaneously, to realize desired hybrid information processing functions.

FIG. 16 is a schematic diagram of an integrated hybrid processor, which connects numerous hybrid dividers in both parallel and serial configurations, to realize desired hybrid information processing functions. The integrated hybrid processor is the integration of the serial connection (discussed and shown with respect to FIGS. 10 and 11) and parallel connection (discussed and shown with respect to FIGS. 12 and 13). These hybrid dividers are connected to actuators, and those actuators can be controlled by the previous group of hybrid dividers while their output can be chosen to act as the input signal of next group of dividers. For example, hybrid dividers $A_1$, $A_2$, . . . $A_n$ are connected in parallel and their outputs are connected to actuators 11, 12, . . . 1*n*. $\text{Actuator}_{1n-1}$ will be controlled by the output of $A_{n-1}$ and $A_n$, and its output can be used as the input of $B_{n-1}$. Through the switches, the input signals of each hybrid divider can be freely chosen to be the output of actuators, the output of other dividers, the feedback signals or other input voltage or signals. Through this processor, most of the desired hybrid information processing functions can be realized, such as hybrid copier, encoder, decoder and multiplexer.

Example 9

Figure 17:
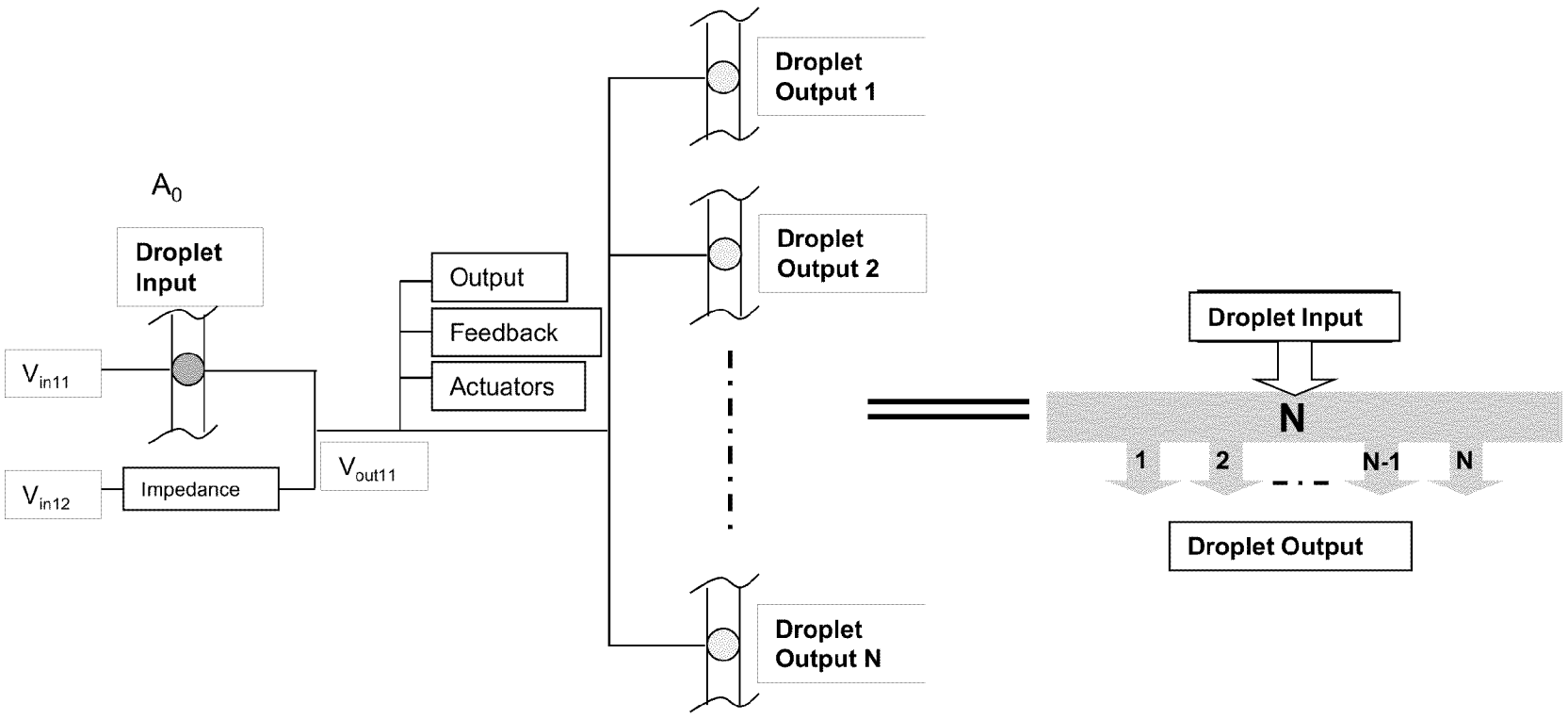
FIG. 17 is a schematic diagram of an N-folds hybrid copier, which can copy both droplet and electric signals, and a defined equivalent symbol diagram of the droplet copier.
Figure 18:
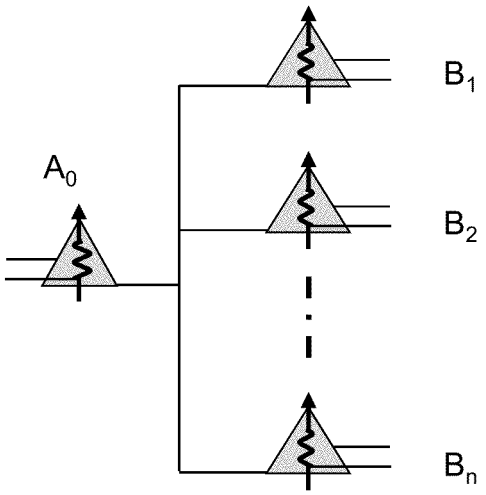
FIG. 18 is a symbolic diagram of the N-folds hybrid copier of FIG. 17.

FIGS. 17 and 18 show the design of an N-fold hybrid copier. FIG. 17 is the schematic diagram of the N-fold hybrid copier. The droplet input can be transformed to be $V_{out11}$ by hybrid divider $A_0$, and used as the control of droplet output 1, 2, . . . N. Once a droplet passes through the microfluidic channel in hybrid $A_0$, the channels of respective droplet outputs 1, 2, . . . N will each generate one droplet. The size of the generated droplets can be random multiples of the input droplets, depending on the flow rates. For example, if the flow rate of the droplet input is x, and the flow rates of the droplet output 1 and 2 are 2× and 0.5×, respectively, the lengths of droplets generated in the corresponding channels of droplet outputs 1 and 2 will be two times and one-half of the input droplet signal, respectively.

A defined equivalent symbol diagram of the droplet copier is shown on the right of FIG. 17. However, the input and output does not necessarily have to correspond to the droplet information; they can be both droplet and electric signals.

A symbolic diagram of the N-fold hybrid copier is shown in FIG. 18. It can be seen as a simple example of the integrated processor as FIG. 16, which has only $A_0$ and $B_1$, $B_2$ . . . $B_N$.

Example 10

Figure 19:
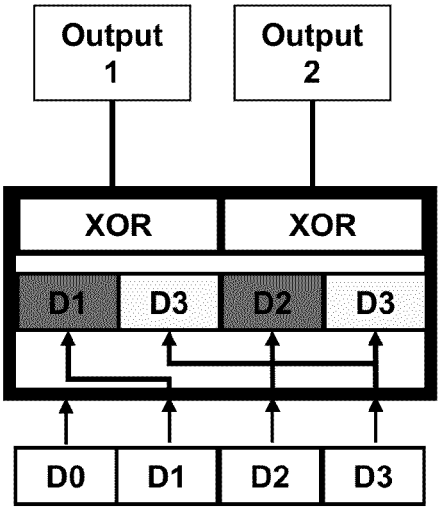
FIG. 19 is a symbolic diagram of a hybrid encoder, specifically a 4 to 2 line encoder.

FIG. 19 is a symbolic diagram showing an example of an integrated processor—hybrid encoder, in particular, a 4 to 2 line encoder. The inputs $D_0$, $D_1$, $D_2$ and $D_3$ can be droplets or electric signals. The encoder can be seen as the combination of two XOR logic gates. The inputs of the first the XOR gate are $D_1$ and $D_3$, while the inputs of the second XOR gate are $D_2$ and $D_3$.

The operation of this encoder is listed in Table 11. Please note that $x=D_2+D_3$ and $y=D_1+D_3$.

TABLE 11

Truth table for hybrid 4 to 2 line encoder

| $D_0$ | $D_1$ | $D_2$ | $D_3$ | Output 1 | Output 2 |
|---|---|---|---|---|---|
| 1 | 0 | 0 | 0 | 0 | 0 |
| 0 | 1 | 0 | 0 | 0 | 1 |
| 0 | 0 | 1 | 0 | 1 | 0 |
| 0 | 0 | 0 | 1 | 1 | 1 |

The realization method of XOR logic gate can be found in the previous description of the universal logic gate by connecting two hybrid dividers.

Example 11

Figure 20:
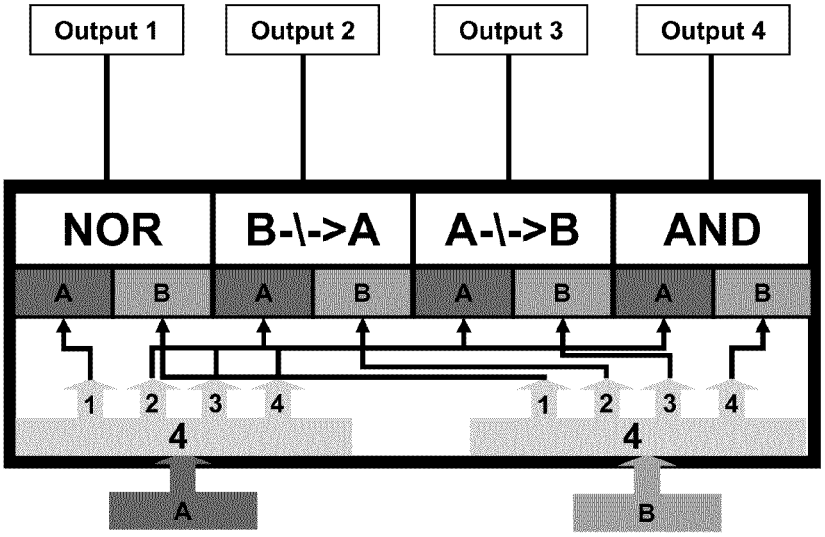
FIG. 20 is a symbolic diagram of a hybrid decoder, specifically a 2 to 4 line decoder.

FIG. 20 is a symbolic diagram of a hybrid 2 to 4 line decoder. The truth table of the decoder is found in Table 12.

TABLE 12

Truth table for hybrid 2 to 4 line decoder

| A | B | Output 1 | Output 2 | Output 3 | Output 4 |
|---|---|---|---|---|---|
| 0 | 0 | 1 | 0 | 0 | 0 |
| 0 | 1 | 0 | 1 | 0 | 0 |
| 1 | 0 | 0 | 0 | 1 | 0 |
| 1 | 1 | 0 | 0 | 0 | 1 |

The decoder comprises four logic gates: a NOR gate, a B-\->A gate, an A-\->B gate and an AND gate. These gates can be realized by connecting to hybrid dividers and the descriptions for doing so can found in the preceding description of universal logic gates. Input signals A and B can be droplets or electric signals. The signals will act simultaneously as the inputs of the gates, and outputs 1, 2, 3 and 4 are decided by the 4 logic gates, respectively. For example, if A comes as a droplet and B not, the output of A-\->B gate will be 1 and other gates will have output signal 0. If the outputs are used to control the opening or closing of different fluid channels, channel 3 will be open as the signal of output 3 now is 1.

Figure 21:
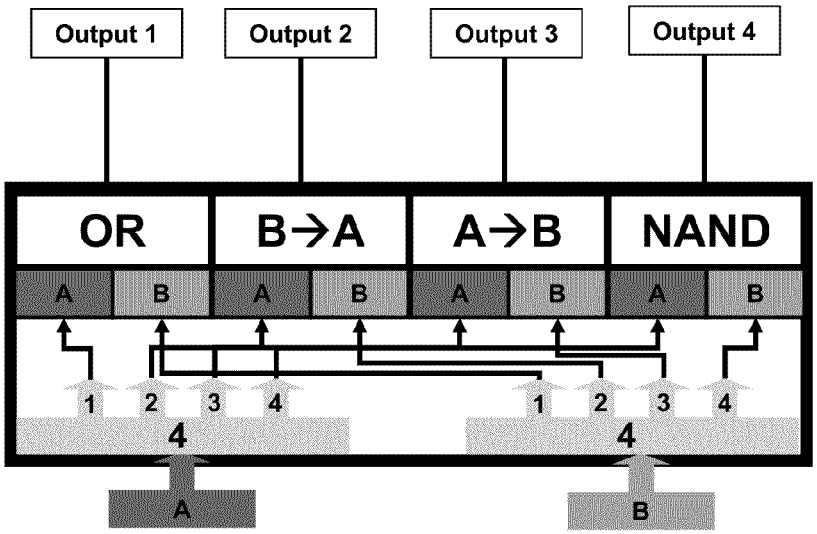
FIG. 21 is a symbolic diagram of an inverted hybrid decoder.

FIG. 21 is a symbolic diagram of a hybrid 2 to 4 line inverse decoder.

The output signal is the inverse of the decoder of FIG. 20. The inverse decoder shown in FIG. 21 uses four other logic gates, namely: OR gate, B->A gate, A->B gate and NAND gate.

The corresponding truth table is shown in Table 13:

TABLE 13

Truth table for 2 to 4 line inverse decoder

| A | B | Output 1 | Output 2 | Output 3 | Output 4 |
|---|---|---|---|---|---|
| 0 | 0 | 0 | 1 | 1 | 1 |
| 0 | 1 | 1 | 0 | 1 | 1 |
| 1 | 0 | 1 | 1 | 0 | 1 |
| 1 | 1 | 1 | 1 | 1 | 0 |

Example 12

Figure 22:
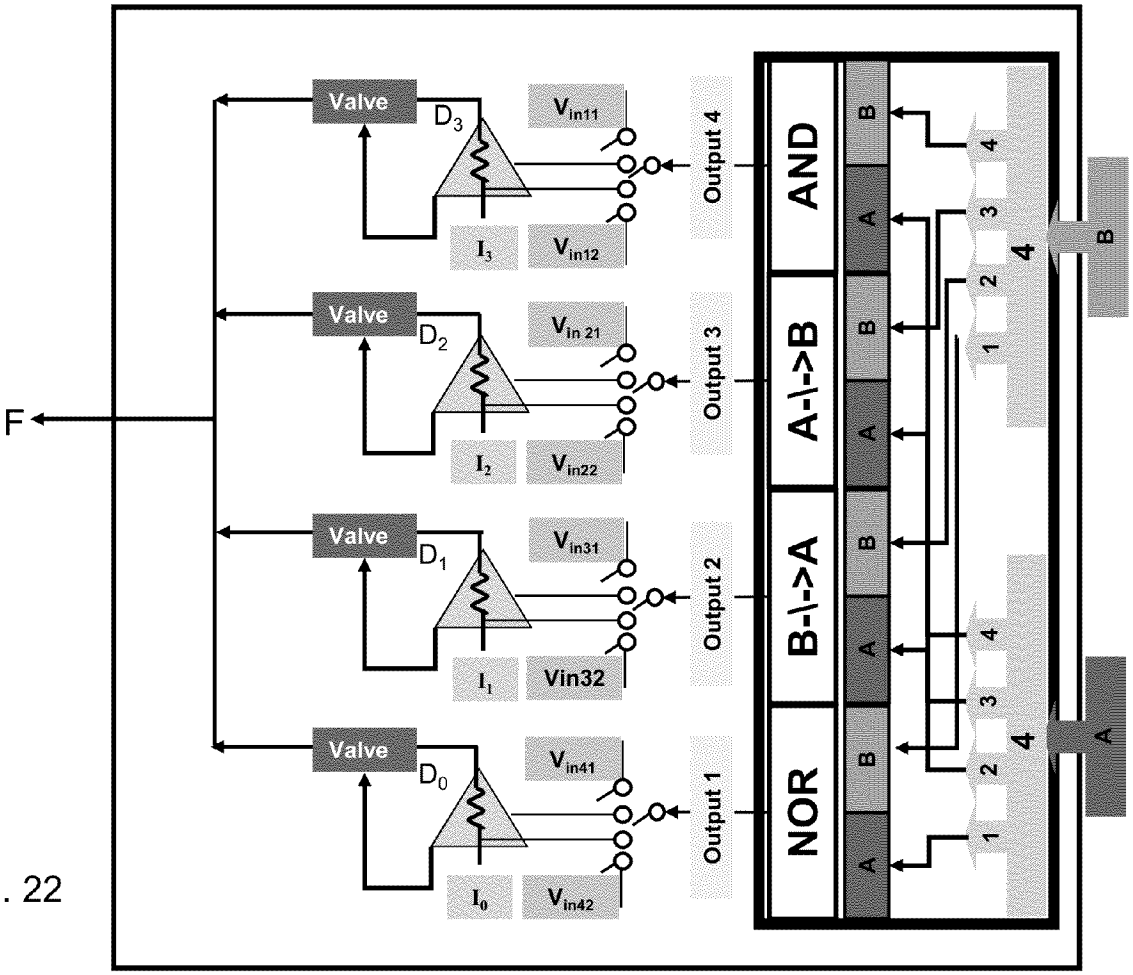
FIG. 22 is a symbolic diagram of a multiplexer, specifically a 4 input fluidic multiplexer.
Figure 23:
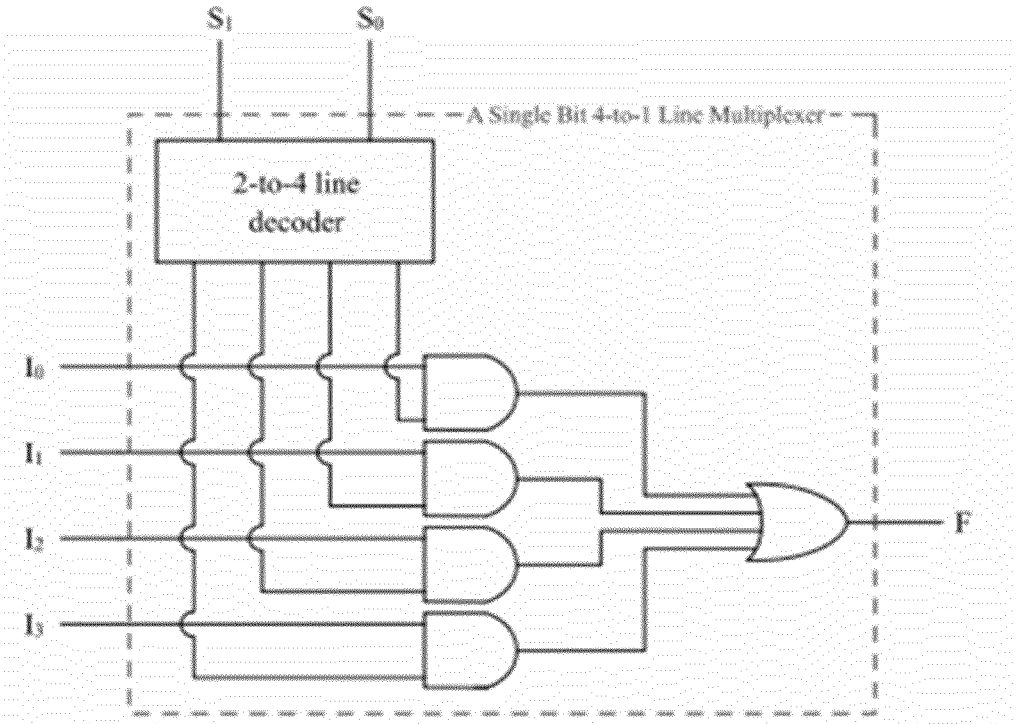
FIG. 23 is a truth table of the multiplexer of FIG. 22.

FIG. 22 is a symbolic diagram of a multiplexer, specifically a 4-input multiplexer. FIG. 23 is a truth table corresponding to the multiplexer of FIG. 22. In the truth table of FIG. 23, the signals of input A and B are defined as $S_0$ and $S_1$, respectively. The input A and B and the output signal F can be both droplets and/or electric signals. The multiplexer uses the decoder previously described as the first operation, and the output signal of the decoder can be further operated by four hybrid dividers, connected to four valves each and their output signal can be used to control the valve it connects to. For example, if $S_0$ is 1 and $S_1$ is 0, then output 3 will be 1 and output 1, 2 and 4 will be 0. If hybrid divider $D_2$ acts as a hybrid switch, then the valve 2 will be open and other valves will be closed. The output signal F will be the same as $I_2$.

The hybrid divider and the integrated hybrid processor may be fabricated by any appropriate method. One possible method is described by way of example below, and illustrated in FIG. 24.

Example 13

Figure 24:
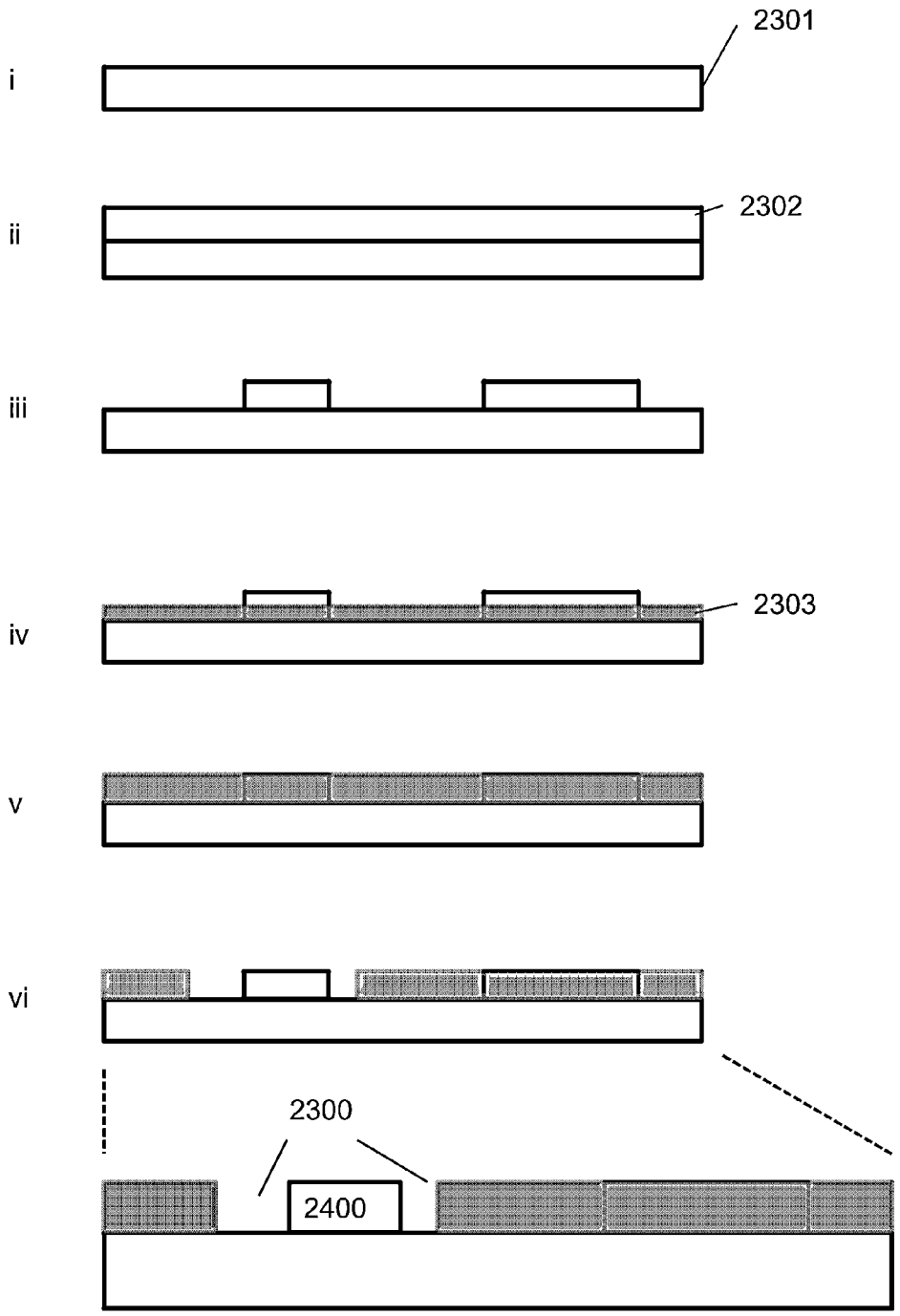
FIG. 24 is a diagram showing stages in the manufacturing process of a hybrid divider or integrated hybrid processor on a PDMS based microfluidic chip.

In brief a mold is first formed by coating photoresists on a wafer and patterning the photoresists by selective exposure to light. A PDMS gel or pre-polymer is then poured into the mold and solidified. The PDMS thus adopts the desired shape with channels and cavities for receiving the conductive material for the electrodes and conducting lines. After solidification, the PDMS is removed from the mold and finished by sealing with another piece of PDMS on top to enclose the channels and the electrodes. FIG. 24 illustrates steps in manufacturing the mold.

Two kinds of photoresist are employed. The first kind of photoresist is used to fabricate the mold for the fluid channels, while the second kind of photoresist is used to fabricate the mold for the cavities for receiving the electrodes and/or conducting lines. The photoresists preferably have the same or substantially the same thickness. The second kind of photoresist may be removed by organic solvent, e.g. acetone, while the first type cannot be easily removed by organic solvent. For example, the first photo resist may be SU-8 (negative) and the second photoresist may be AZ-4903 (positive). In one arrangement, SU-8 is used to fabricate the mold for the fluid channels (to a thickness of about 80~90 m), and AZ-4903 double-coating is used to fabricate the cavities for receiving the conducting lines and/or electrodes (also to a thickness of about 80~90 μm).

Step 1: Cleaning the Glass Wafer

The glass wafer 2301 is cleaned with standard cleaning solution, e.g. $NH_4OH:H_2O_2:H_2O$=1:1:5 (volume ratio). The glass wafer is bathed in this solution for a period of time, e.g. at 70° C. for 15 minutes. The glass wafer is then cleaned with de-ionized (DI) water to remove the cleaning solution and dried with compressed $N_2$ gas. After that, the glass wafer is baked in an oven (e.g. at 120° C. for more than 30 minutes) to remove the water on its surface. The wafer is then cooled down to room temperature. The cleaned wafer is shown in FIG. 24, substep (i). A silicon wafer can be used instead of a glass wafer, in which case the method is similar, but exposure energy may be different, as will be understood by a person skilled in the art.

Step 2: Photolithography of SU-8 Pattern

Photoresist SU-8 is spin-coated onto the wafer at a suitable spin rate (e.g. for SU-8 2025, one suitable spin rate is 500 rpm for 10 s and then 1000 rpm for 30 s; for SU-8 2050, a suitable spin rate may be 500 rpm for 10 s and then 1700 rpm for 30 s). Alternatively, a different positive photoresist can be used to achieve the same thickness. The sides of the wafer are cleaned carefully and the whole wafer is placed on a level clean surface for a sufficient time to make the surface of the SU-8 photoresist 2302 substantially flat. The wafer is then soft baked on a hotplate: e.g. at 65° C. for 5 minutes and then at 95° C. for 15 minutes and finally at 65° C. for 2 minutes. The wafer is then placed on a level clean surface for a period of time, preferably at least 10 minutes. The wafer after it has been spin coated with SU-8 is shown in FIG. 24, substep (ii).

After that, the wafer is exposed with exposure energy of about 600 mJ/cm2. During the exposure, a mask with the desired pattern is placed close to the baked photoresist. After exposure, the wafer should be placed on a leveled clean surface for at least 10 minutes to complete the reaction in the photoresist layer. Later, the wafer is hard baked on a hotplate, e.g. at 65° C. for 5 minutes, 95° C. for 10 minutes and 65° C. for 2 minutes, to evaporate the solvent, and then placed on a level clean surface for at least 10 minutes. The last step is to develop the wafer in SU-8 developer for around 10 minutes and make sure that all of the unexposed SU-8 is removed. The wafer can be checked and then cleaned with isopropyl alcohol (IPA), and dried with compressed $N_2$ gas. The wafer after the SU-8 patterning is complete is shown in FIG. 24, substep (iii).

Step 3: Photolithography of AZ-4903 Pattern

The photoresist AZ-4903 is pre-coated by hand to evenly distribute AZ-4903 photoresist 2303 on the wafer, particularly the part of the wafer with the SU-8 pattern. The pre-coated wafer is then placed on a spin-coater machine and spun, e.g. at a rate of 500 rpm for 5 s and then 800 rpm for 30 s. The sides of the wafer are cleaned carefully and the wafer is then left on a level clean surface for a period of time, e.g. 3 minutes. Then the wafer is then baked on a hotplate: e.g. at 50° C. for 5 minutes and 110° C. for 3 minutes. After baking, the wafer is left on a level clean surface to cool down to room temperature. The assembly after spin coating of the first layer of AZ-4903 is shown in FIG. 24, substep (iv).

Next, the spin coating process is repeated for a second layer of AZ-4903. This time it is baked on a hotplate, e.g. at 50° C. for 5 minutes and 110° C. for 8 minutes. After baking, the wafer is left on a level clean surface to cool down to room temperature. Then, the part of the wafer with marks (e.g. a part with small structures of SU-8 pattern at the side of the wafer) may be cleaned. The cleaning may involve removing the AZ-4903 from these parts by use of acetone, so that they can be seen clearly during alignment. The assembly after spin coating of the second layer of AZ-4903 is shown in FIG. 24, substep (v).

A mask is put on the surface of the wafer and aligned under a microscope. Once aligned, the wafer is exposed to UV with exposure energy of about 2000 mJ/cm$^2$. After exposure, the wafer is placed on a leveled clean surface for at least 10 minutes to complete the reaction in the photoresist layer.

The wafer is developed by a solution which comprises AZ400K:$H_2O$=1:3 (volume ratio) for several minutes until all the exposed parts are removed. Then, the wafer is cleaned by DI water and dried with compressed $N_2$ gas. The assembly after patterning of the AZ-4903 is shown in FIG. 23, substep (vi). At this stage, the wafer has two cavities 2300 for the electrode fabrication and a part for channel fabrication 2400.

Step 4: Surface Treatment

The fourth step is to carry out surface treatment to avoid the electrode and/or conductive line material (e.g. Ag-PDMS) from sticking to the surface of the wafer. This may be done by evaporating silane from the surface of the fabricated wafer under vacuum conditions, or by other suitable surface treatment methods.

Step 5: Electrode Fabrication

PDMS gel is fabricated, e.g. by mixing the base and curing agent at a ratio of 10:1 (by weight). Then electrode material (e.g. Ag micro particles, preferably of 1-2 μD size) is mixed with the PDMS gel, e.g. at a ratio of 6.8:1 (by weight). The mixture is then filled into the cavities 2300 on the wafer pattern. Any redundant parts are removed by scrubbing the wafer face-down, first with a flat smooth scrubber (such as typing paper) and then with a smoother scrubber (such as weighing paper).

After baking in an oven, e.g. at 60° C. for 30 minutes, the assembly is bathed in acetone for about 1 minute to remove the photoresist AZ-4903. The acetone is then removed by bathing in ethanol, and finally the ethanol is removed by DI water. The assembly is then baked in an oven, e.g. at 60° C. for 10 minutes.

Step 6: Channel Fabrication

PDMS gel of approximately 2 mm (the same fabrication method as described above) is poured on the surface of the wafer. The assembly is then baked in an oven at 60° C. for 2 hours or so. Then the cured PDMS slab is removed from the wafer carefully and holes are drilled at the outlet parts PDMS gel of approximately 1 mm is poured on a flat surface and then baked, e.g. at 60° C. for around 20 minutes, until it is almost solidified but still is a little bit sticky. Then, the PDMS slab, which has been fabricated, is placed on the surface of an almost-solidified PDMS layer (which forms a roof or top part for sealing the channels). After baking in an oven at 60° C. for 30 minutes, the entire assembly is put on a hotplate at 150° C. for 2 hours to ensure that the electrode material (e.g. AgPDMS) is conductive. The fabrication process of the chip is completed.

Example 14

Figure 25:
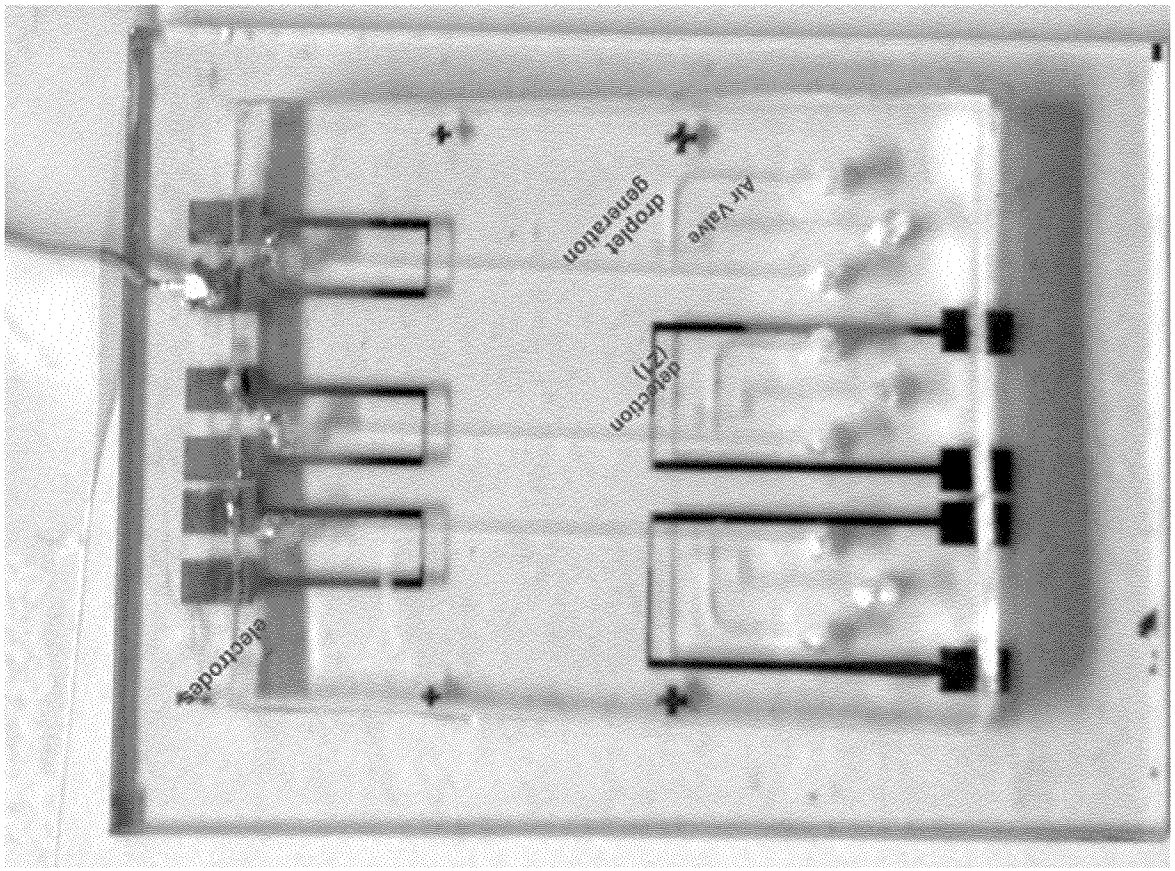
FIG. 25 is a fabricated example of a chip having three hybrid dividers.

The hybrid divider chip may generally comprise a droplet generation module, of T junction or flow focusing form, for example, a valve/actuator, and related impedance. FIG. 25 shows one fabricated example of a chip having three hybrid dividers, each having electrodes coated on the glass substrate, channels with two inlets and an on-chip air valve. The air source is off-chip, and the control is exerted by a solenoid valve, which is controlled by fluidic signal. The example shown in FIG. 25 utilizes the chip layers to trigger and release signal and flow of voltage and fluid. Although three hybrid dividers are shown on one chip in FIG. 25, a chip may contain one or more hybrid dividers and may be internally connected via electronic wells or externally connected via electronic wells to achieve the logic functions, structures and components discussed herein.

Figure 26:
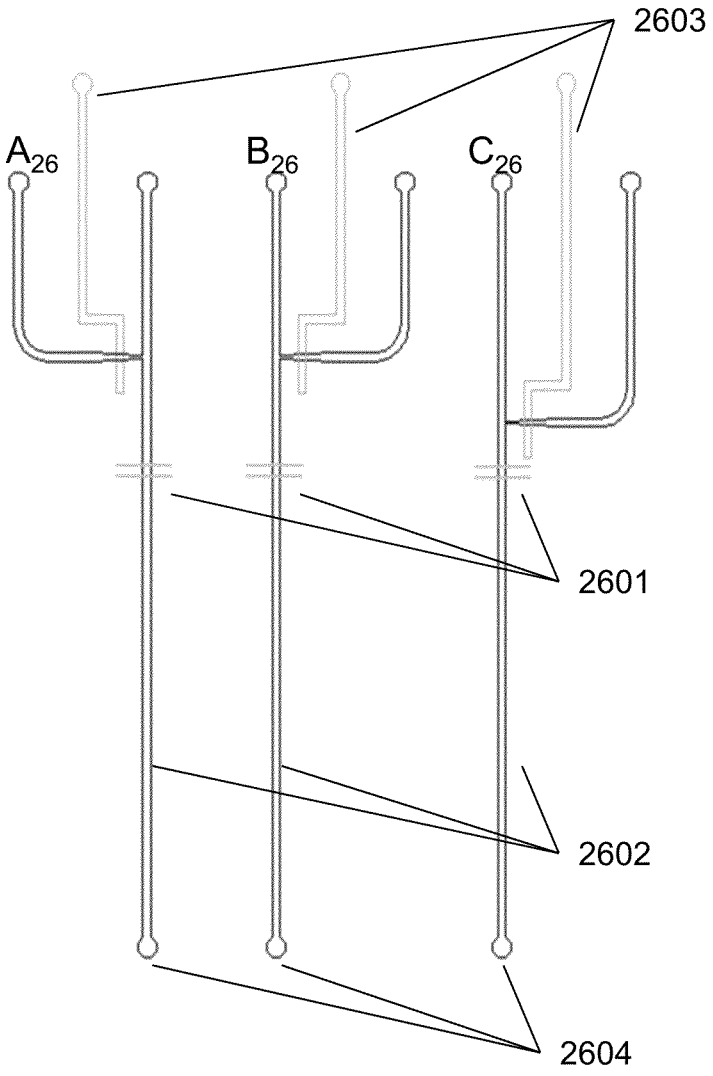
FIG. 26 is a schematic diagram of the configuration of FIG. 25.

FIG. 26 is a schematic diagram for one possible configuration of three hybrid dividers, corresponding to the fabricated example shown in FIG. 25. Three hybrid dividers, $A_{26}$, $B_{26}$ and $C_{26}$, are fabricated on the same chip, such that $A_{26}$ and $B_{26}$ are used for droplet input, and $C_{26}$ is used for droplet output after arithmetic. Each hybrid divider has a respective detection electrode 2601, on the substrate layer, fluidic channel 2602 on another layer, and air valve 2603 on yet another layer. Wells 2604 are used as 'starting' and 'stopping' points for the fluid and droplets and may further be connected to electronic components for analysis.

The three hybrid dividers as shown in FIG. 26 may be used to achieve the experimental results described above with respect to Example 7, FIG. 14 and the logic functions displayed in Tables 3-8.

Example 15

Figure 27:
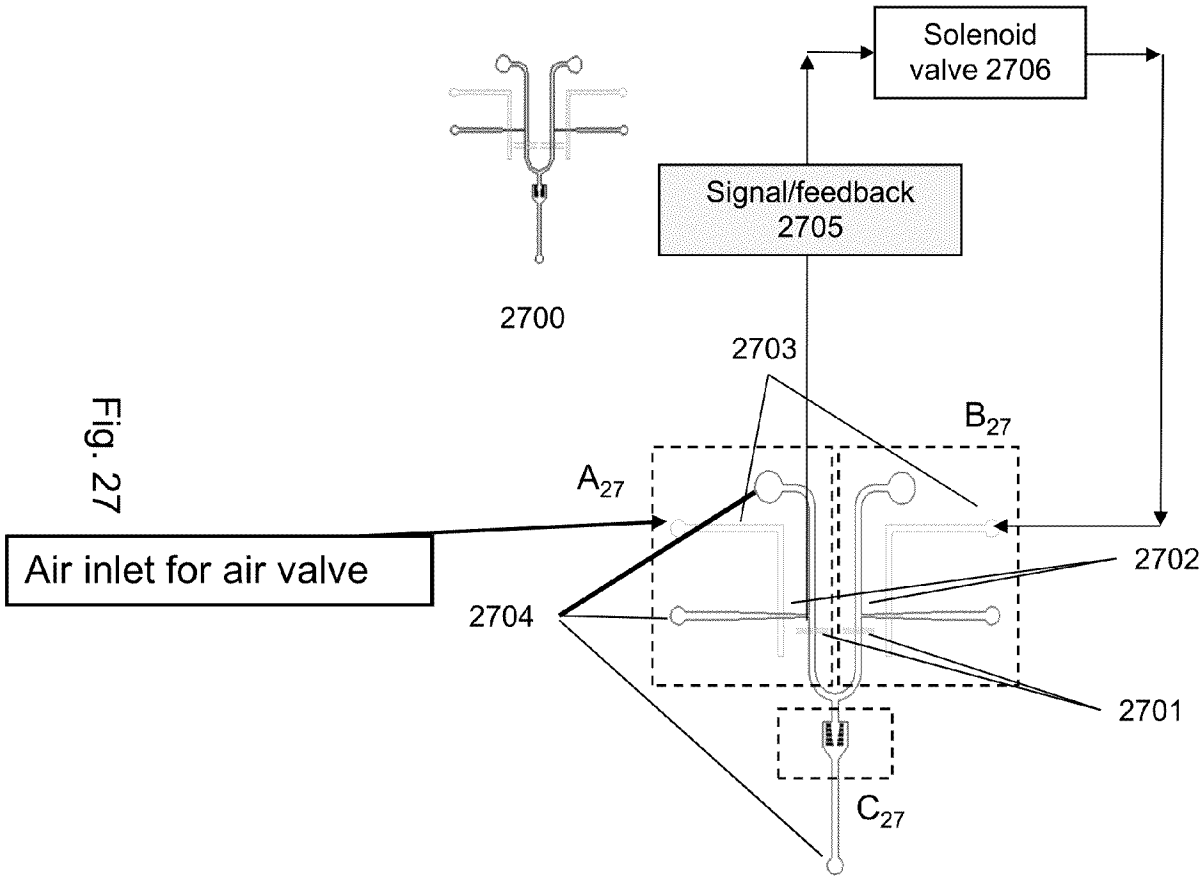
FIG. 27 is a schematic diagram showing another example of a droplet reaction module.

FIG. 27 shows another example of a droplet reaction module, 2700 in both general form, and in one possible experimental configuration. The droplet reaction module 2700 further illustrates the ability of the hybrid divider to be easily integrated with other realized microfluidic functions for advanced functions. Droplet detection is inherent to the module; other examples of realized microfluidic devices using similar design include droplet storage, droplet display etc. The droplet reaction module may be used to realize nano to pico liter volume size chemical reaction(s), micro-synthesis or protein reaction. The droplet reaction module comprises a main part of two hybrid dividers $A_{27}$ and $B_{27}$, and a droplet merge module $C_{27}$. As in FIG. 26, each hybrid divider has a respective detection electrode 2701, on the substrate layer, fluidic channel 2702 on another layer, and air valve 2703 on yet another layer. Wells 2704 are used as 'starting' and 'stopping' points for the fluid and droplets and may further be connected to electronic components for analysis.

The chemical/droplet a' from hybrid divider $A_{27}$ may be generated randomly, or purposely, for example by the following sequence. The air valve $\mathbf{2703}_{B27}$ of hybrid divider $B_{27}$ is normally ON, meaning no droplets were generated from the T function of hybrid divider $B_{27}$. If and only if the droplet a' passes by detection electrode $\mathbf{2701}_{427}$ of hybrid divider $A_{27}$, is an triggering signal/feedback 2705 given to change the voltage share on the solenoid valve 2706, activating the threshold voltage of valve 2706, such that the air valve $\mathbf{2703}_{B27}$ of hybrid divider $B_{27}$ is activated to be OFF, and a droplet b' is generated. The time to activate air valve $\mathbf{2703}_{B27}$ is exactly the same time for droplet a' to pass by detection electrodes $\mathbf{2701}_{A27}$. Therefore, if the flow speed in hybrid dividers $A_{27}$ and $B_{27}$ are the same, then droplet b' of hybrid divider $B_{27}$ will be created in the same volume as droplet a'. This may define a "self-response equal dose reaction," and be used as appropriately in laboratory, chemical, medical and other applications. The form of valve used to generate droplets is not limited to an air valve only. Screw valves, mechanical valves, and other forms of valves are also contemplated and may be substituted, so long as the valve responds to voltage signal. Similarly, as with all of the examples herein, the liquids or droplets may be of any type, so long as the liquid will respond to a voltage signal. Thus, the type, composition and amount of liquids and droplets may be adjusted to suit the specific application and with consideration to the available fluids and other usage factors.

The module may also be used to check the strength of the module fabrication and volume of the droplets. For example, if the flow speeds of the hybrid dividers are not the same, for example, if $B_{27}$ has double the flow speed of $A_{27}$, then the reactive 'dosage' of droplet a' and b' would be effective in a 1:2 ratio, which is also meaningful in practice.

The module may also be further connected or configured in series or in parallel, to realize, for example, four dividers to realize a reaction with four kinds of chemicals.

Figure 28:
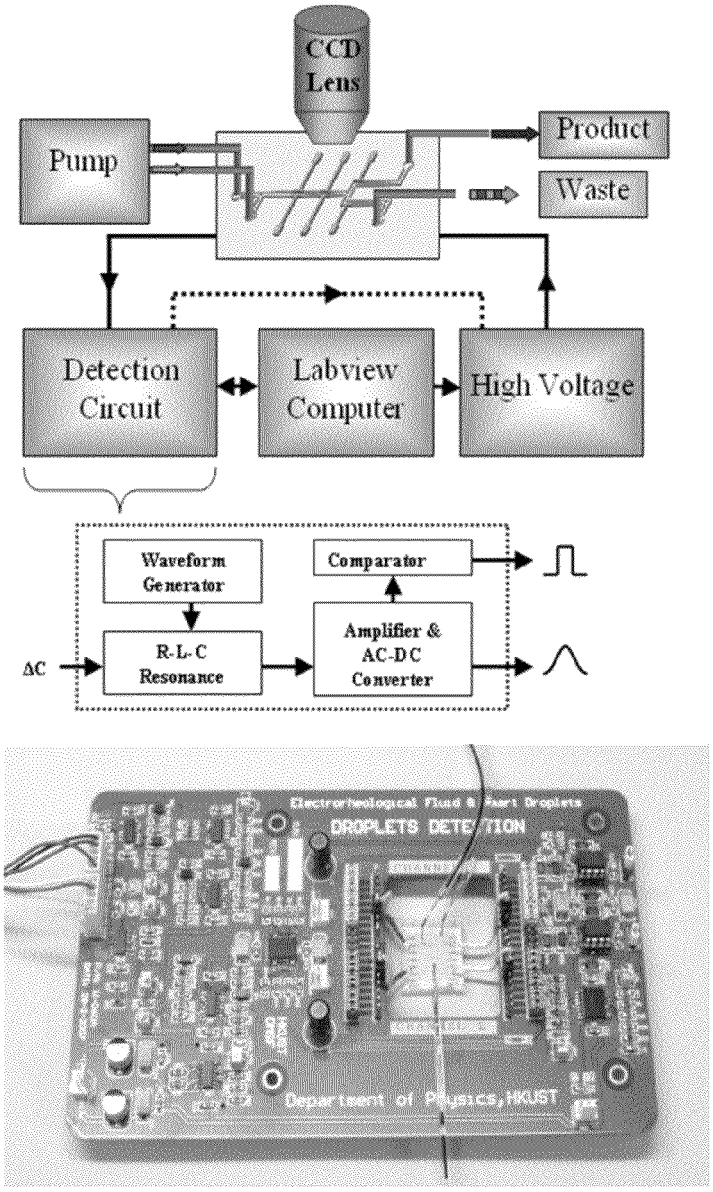
FIG. 28 is an illustrative comparison of a schematic diagram of the droplet detection module in use and a corresponding prototype example.

The droplet detection module discussed herein is one of the simplest existing modules, utilizing non-specialized components, such as any generic form of impedance(s), and with a far-reaching application scope. Thus, its capable measurement of impedance and changed voltage could be very accurate and advanced. The advantages of this technology are not limited to its accuracy; the size and ease of integration of the hybrid divider and hybrid processor scheme facilitate the use of the devices and components discussed herein, and its variations, as alternatives to or as compatible co-existing add-ons to many existing advanced technologies. FIG. 28 illustrates the compatibility of the instant technology, in both schematic and prototype form, with an advanced impedance measurement technology also by the inventors, of Application Information TBD, incorporated where appropriate, by reference. This is but one example of the compatibility and usability of the subject matter discussed herein.

The present subject matter may be embodied in other specific forms without departing from its spirit or essential characteristics. The described embodiments are to be considered in all respects as illustrative and not restrictive. For example, the components, connections and configurations herein may be substituted with other applicable components, connections and configurations in a manner acceptable by a person having technical skill in the art. While PDMS is discussed with respect to FIG. 24, the chip may be made of any known or envisioned substrate, including PDMS, glass, silicon, silicon on glass (CSG) paper, PMMA, other polymers, etc., and with or without electrodes. Contemplated valves include solenoids, on-chip air valve, release valve, etc. Potential impedance include resistors, capacitors, inductors, diodes and triodes. A computer may be connected via wires and/or hardware, i.e. to achieve an expanded fluidic interface, and software may be used, whether specialized or commercial, for example, Labview.

For example, the feedback and control elements could be configured by a computer system, if so desired. However, unlike previous research; see for example [NPL 14] and [NPL 11] requiring the use of a computer, and EWOD applications in which droplets are manipulated almost solely by computer, the system described herein does not require a computer, although the use of a computer may complement and enhance the functions described herein. For example, the use of a computer may comprise a very good system to synchronize fluidic signal with computer. In any case, due to the nature of the output, a computer may (significantly) readily access the fluidic logic result/process discussed herein.

The system may also be realized with a chemical component or solely as a chemical device, including achieving simple, complex and tiered or staged chemical reactions.

The scope of the subject matter is, therefore, to be indicated by the appended claims. All changes which come within the meaning and range of equivalency of the claims are to be embraced within their scope.

INDUSTRIAL APPLICABILITY

This subject matter provides practical applications/solutions, in electronic-fluidic hybrid form, constructed by a simple planer droplet generation structure, a pair of signal electrodes, and a responsive control valve, which is programmed to respond to only certain signal droplets, by a basic electronic principle: change of voltage share between impedances. Therefore, detected fluidic information is addressed in both electronic and fluidic forms, and the fluidic pathway is well-confined in a simple planar structure (although its control valve is in a second layer), thereby minimizing the fluidic disturbance. Various configurations comprise a plurality of identical structure(s), which can alter their cumulative function by re-assignment of required voltage share. For example, the hybrid divider can be assembled into a fluidic universal logic gate, of a simple two inlet and one outlet signal channels structure, and switch between sixteen functions by re-assigning voltage share. Therefore, cascaded complex logic functions can be achieved by assembling identical hybrid dividers, and a different logic function can be achieved by only re-assigning voltage share scheme; this is totally compatible with computer programming protocols.

Thus, the instant subject matter not only avoids round-trip fluidic manipulation, but also realizes automatic response and logic manipulation. Re-programmable hybrid circuitry may be achieved using standardized device architecture for large scale integration, and in a manner compatible with existing microfluidic and electronic technology.

Additional industrial applications that may adopt the subject matter include microfluidic encoder/decoder, micro drug screening system, microfluidic computer, micro syntheses system, analytical devices, industrial & environmental testing, and drug delivery, including achieving simple, complex and tiered or staged chemical reactions, among others.

CITATION LIST

Patent Literature

[PTL 1]
U.S. Pat. No. 7,640,947
[PTL 2]
U.S. Patent Application Publication No. 2007/0163663
[PTL 3]
U.S. Patent Application Publication No. 2008/0185057
[PTL 4]
U.S. Patent Application Publication No. 2010/0089587
[PTL 5]
U.S. Patent Application Publication No. 2010/0151561

Non-Patent Literature

[NPL 1]
M. Abdelgawad and A. R. Wheeler, "The Digital Revolution: A New Paradigm of Microfluidics", *Advanced Materials,* 21: 920-925 (2009).
[NPL 2]
L. M. Adleman, "Molecular computation of solutions to combinatorial problems", *Science,* 266: 1021-1024 (1994).
[NPL 3]
N. R. Beer, B. J. Hindson, E. K. Wheeler, S. B. Hall, K. A. Rose, I. M. Kennedy and B. W. Colston, "On-chip, real-time, single-copy polymerase chain reaction in picoliter droplets", *Analytical Chemistry,* 79 (22): 8471-8475 (2007).
[NPL 4]
Y. Benenson, B. Gil, U. Ben-Dor, R. Adar and E. Shapiro, "An autonomous molecular computer for logical control of gene expression", *Nature,* 429:423-429 (2004).
[NPL 5]
L. F. Cheow, L. Yobas and D-L. Kwong, "Digital microfluidics: Droplet based logic gates", *Applied Physics Letters,* 90, 054107: 1-3 (2007).
[NPL 6]
S. Derveaux, B. G. Stubbe C. Roelant M. Leblans, B. G. De Geest, J. Demeester and S. C. De Smedt, "Layer-by-layer coated digitally encoded microcarriers for quantification of proteins in serum and plasma", *Analytical Chemistry,* 80 (1): 85-94 (2008).
[NPL 7]
I. R. Epstein, "Can droplets and bubbles think?" *Science,* 315: 775-776 (2007).
[NPL 8]
R. B. Fair, "Digital microfluidics: is a true lab-on-a-chip possible?" *Microfluidics and Nanofluidics,* 3: 245-281 (2007).
[NPL 9]
A. Groisman, M. Enzelberger and S. R. Quake, "Microfluidic memory and control devices," *Science,* 300: 955-958 (2003).
[NPL 10]
J. P. Kutter, "Current developments in electrophoretic and chromatographic separation methods on microfabricated devices", TrAC-Trends in *Analytical Chemistry,* 19: 352-363 (2000).
[NPL 11]
B. Mosadegh, C.-H. Kuo, Y.-C. Tung, Y-S. Torisawa, T. Bersano-Begey, H. Tavana and S. Takayama, "Integrated elastomeric components for autonomous regulation of sequential and oscillatory flow switching in microfluidic devices", *Nature Physics,* 6: 433-437 (2010).
[NPL 12]
X. Niu, W. Wen and Y.-K. Lee, "Electrorheological-fluid-based Microvalves", *Applied Physics Letters,* 87, 243501: 1-3 (2005).
[NPL 13]
V. K. Pamula, V. Srinivasan, H. Chakrapani, R. B. Fair and E. J. Toone, "A Droplet-based Lab-on-a-chip for Colorimetric Detection of Nitroaromatic Explosives", *Proceedings of the 18th IEEE International Conference on Micro Electro Mechanical Systems*, 722-725 (2005).
[NPL 14]
M. Prakash and N. Gershenfeld, "Microfluidic Bubble Logic", *Science,* 315: 832-835 2007).
[NPL 15]
M. G. Pollack, R. B. Fair and A. D. Shenderov, "Electrowetting-based actuation of liquid droplets for microfluidic applications", *Applied Physics Letters,* 77: 1725-1726 (2000).
[NPL 16]
M. Rhee and M. A. Burns, "Microfluidic Pneumatic Logic Circuits and Digital Pneumatic Microprocessors for Integrated Microfluidic Systems", *Lab Chip,* 9: 3131-3143 (2009).
[NPL 17]
V. Srinivasan, V. K. Pamula and R. B. Fair, "An integrated digital microfluidic lab-on-a-chip for clinical diagnostics on human physiological fluids", *Lab Chip,* 4: 310-315 (2004).
[NPL 18]
V. Srinivasan, V. K. Pamula and R. B. Fair, "Droplet-based microfluidic lab-on-a-chip for glucose detection", *Analytica Chimica Acta,* 507:145-150 (2004).
[NPL 19]
T. Thorsen, S. J. Maerkl and S. R. Quake, "Microfluidic Large Scale Integration", *Science,* 298: 580-584 (2002).
[NPL 20]
M. W. Toepke, V. V. Abhyankar and D. J. Beebe "Microfluidic logic gates and timers", *Lab on a Chip-Miniaturisation for Chemistry and Biology,* 7: 1449-1453 (2007).
[NPL 21]
M. A. Unger, H-P. Chou, T. Thorsen, A. Scherer and S. R. Quake, "Monolithic Microfabricated Valves and Pumps by Multilayer Soft Lithography", *Science,* 288 (5463): 113-116 (2000).
[NPL 22]
T. Vestad, D. W. M. Man and T. Munakata. "Flow Resistance for Microfluidic Logic Operations," *Applied Physics Letters,* 84 (25): 5074-5075 (2004).
[NPL 23]
L. Wang, M. Zhang, J. Li, X. Gong and W. Wen, "Logic control of microfluidics with smart colloid" *Lab Chip,* 10: 2869-2874 (2010).
[NPL 24]
X. Wang, J. Zhou, T. K. Tam, E. Katz and M. Pita, "Switchable electrode controlled by Boolean logic gates using enzymes as input signals", *Biochemistry,* 77: 69-73 (2009).
[NPL 25]
J. A. Weaver, J. Melin, D. Stark, S. R. Quake and M. A. Horowitz, "Static control logic for microfluidic devices using pressure-gain valves", *Nature Physics,* 6: 218-223 (2010).
[NPL 26]
A. R. Wheeler, W. R. Throndset, R. J. Whelan, A. M. Leach, R. N. Zare, Y. H. Liao, K. Farrell, I. D. Manger and A. Daridon, "Microfluidic device for single-cell analysis", *Chemistry,* 75 (14): 3581-3586 (2003).
[NPL 27]
W. Zhan and R. Crooks, "Microelectrochemical Logic Circuits", *Journal of the American Chemical Society,* 125: 9934-9935 (2003).

[NPL 28]

Y. Zhao and K. Chakrabarty, "Digital Microfluidic Logic Gates and Their Application to Built-in Self-Test of Lab-on-Chip", *IEEE Transactions on Biomedical Circuits and Systems,* 4 (4): 250-262 (2010).

[NPL 29]

Y. Zheng, W. Dai, and H. Wu, "A screw-actuated pneumatic valve for portable, disposable microfluidics", *Lab on a Chip—Miniaturisation for Chemistry and Biology,* 9: 469-472 (2009).

The invention claimed is:

1. A droplet detection system comprising:

a plurality of hybrid rheostat/dividers, each hybrid rheostat/divider comprising:

a channel capable of conveying carrier fluid and droplets;

a plurality of voltage adjustable input terminals substitutable by electronic circuit(s);

an electronic component or channel comprising a plurality of electrodes operable with the carrier fluid in the channel, the electronic component or channel comprising an impedance selected from the group consisting of resistor, inductance and capacitor;

an output signal circuit;

a controlling component or feedback component having a first end connected to the output signal circuit, and a second end connected to a controllable device selected from the group consisting of a pump and a valve; and a first conductor electrically connecting one of the electrodes with the impedance, wherein at least two of the electrodes form opposing electrodes about the carrier fluid in the channel; and a droplet merge module.

2. The droplet detection system of claim 1, wherein, the carrier fluid has a first dielectric constant or conductivity and the droplets have a second dielectric constant or conductivity.

3. The droplet detection system of claim 1 further comprising:

an actuator, wherein the presence of a droplet between the electrodes forming the opposing electrodes about the carrier fluid in the channel turns on the actuator.

4. The droplet detection system of claim 3, wherein the actuator has an actuation threshold voltage, and the hybrid divider is connected to the actuator.

5. The droplet detection system of claim 1, wherein at least a subset of the hybrid rheostat/dividers further comprise a plurality of information input/output, including digital information 0 and 1, chemical components, volume of the droplet, kinetics of fluid flow, concentration of a certain chemical, color of the fluid, optical properties of the fluid, and the temperature of the fluid.

6. A droplet storage system comprising:

the droplet detection system according to claim 1; and a long channel comprising a microchannel embeddable pump.

7. The droplet detection system of claim 1, wherein the controlling component or feedback component of at least one of the hybrid rheostat/dividers comprises an electronic controllable system including a pump and a valve that can be used to control droplet generation and fluid flow.

8. A device controller comprising:

the droplet detection system of claim 1, the device controller further comprising at least a subset of the plurality of hybrid dividers connected in parallel, wherein parallel output signals of the hybrid dividers control a device.

9. The device controller of claim 8, further comprising at least one universal logic gate constructed by two hybrid dividers connected in parallel.

10. The device controller of claim 9, wherein logic information comprises binary logic, such that 1 is an actuator enabling signal, and 0 is an actuator disabling signal.

11. The device controller of claim 10, wherein the actuator comprises a pump, valve or a smart material selected from the group consisting of dielectric smart materials, thermal-tunable materials, CPDMS composite, ionic fluids, and other smart materials.

12. The device controller of claim 11, wherein the smart materials comprise electrorheological fluids (ERF) or magnetorheological fluids (MRF).

13. The device controller of claim 11, wherein the smart materials provide an impedance function.

14. The droplet detection system of claim 1, further comprising:

at least a subset of the plurality of hybrid dividers connected in series, the input signal of at least one hybrid divider in the subset selected from the group consisting of an output signal of the preceding hybrid divider or other power supplies.

15. An integrated processor comprising:

the droplet detection system of claim 1, comprising at least a subset of the plurality of hybrid dividers connected in series and parallel to achieve multipurpose tasks.

16. The integrated processor of claim 15, wherein the channels are integrated in one chip or are separated but are connected by electrodes to conducting materials.

17. The droplet detection system of claim 1 wherein the output signal circuit is a $V_{out}$ controlling system that may be applied to control other components.

18. The droplet detection system of claim 17, further comprising a velocity controlling module of fluid flow, wherein the output signal circuit is connected to a micropump responsive to voltage changes, and wherein a high output voltage value increases velocity of the fluid flow, and a low output voltage value decreases velocity of the fluid flow.

19. The droplet detection system of claim 1, further comprising:

one or more of the hybrid rheostat/dividers configured to act as a hybrid copier, hybrid computer, encoder, decoder, multiplexer, or other logic device.

20. The droplet detection system of claim 1, wherein the controlling components are chosen from the group consisting of smart materials, electrorheological fluids (ERF), magnetorheological fluids (MRF), 3D connection to realize soft valves, air pump, etc., electromagnetic valves and fluidic valves.

21. The droplet detection system of claim 1, wherein the impedance is connectable in an infinite number of parallel and series configurations, and wherein the impedance is connectable to any circuit for precise fluidic/electric control/information processing.

22. A droplet generation module comprising:

the droplet detection system according to claim 1, wherein the components and or channels are fabricated on a plurality of layers of a chip, and wherein the chip layer geometry is capable of triggering and releasing electric and fluidic signals and flow of at least voltage and fluid.

23. A hybrid divider comprising;

a channel capable of conveying carrier fluid and droplets;

a plurality of voltage adjustable input terminals substitutable by electronic circuit(s);

an electronic component or channel comprising a plurality of electrodes operable with the carrier fluid in the channel, the electronic component or channel comprising an impedance selected from the group consisting of resistor, inductance and capacitor;

an output signal circuit;

a controlling component or feedback component having a first end connected to the output signal circuit, and a second end connected to a controllable device selected from the group consisting of a pump and a valve; and a first conductor electrically connecting one of the electrodes with the impedance, wherein at least two of the electrodes form opposing electrodes about the carrier fluid in the channel, wherein the output signal circuit is a $V_{out}$ controlling system that may be applied to control other components, wherein the output signal circuit can be connected to an input of additional hybrid dividers to control the subsequent additional divider unit(s), and wherein an output signal from the output signal circuit can be applied as the input of the controlling component and the feedback component.

24. An apparatus comprising:

one or more hybrid dividers comprising:

a channel capable of conveying carrier fluid and droplets;

a plurality of voltage adjustable input terminals substitutable by electronic circuit(s);

an electronic component or channel comprising a plurality of electrodes operable with the carrier fluid in the channel, the electronic component or channel comprising an impedance selected from the group consisting of resistor, inductance and capacitor;

an output signal circuit;

a controlling component or feedback component having a first end connected to the output signal circuit, and a second end connected to a controllable device selected from the group consisting of a pump and a valve;

the one or more hybrid dividers is configured to act as a hybrid copier, hybrid computer, encoder, decoder, multiplexer, or other logic device; and a first conductor electrically connecting one of the electrodes with the impedance, wherein at least two of the electrodes form opposing electrodes about the carrier fluid in the channel, wherein the hybrid copier comprises a hybrid divider connected to several droplet generation systems, and wherein when the droplet in the hybrid divider is present between two electrodes, the output signal can control the generation system to generate droplets.

25. The apparatus of claim 24, wherein the encoder converts fluid information from one format to another.

26. The apparatus of claim 24, wherein the decoder performs the reverse functions of an encoder.

27. The apparatus of claim 24, comprising logic gates assembled by two hybrid dividers, wherein the encoder converts fluid information from one format to another, and wherein the decoder performs the reverse functions of an encoder.

28. The apparatus of claim 24, wherein the multiplexer comprises a decoder connected to one or more hybrid switches.

29. The apparatus of claim 28, wherein an actuator of the hybrid switches is a valve controllable by the output signal of the hybrid divider.

30. An apparatus comprising:

one or more hybrid dividers comprising:

a channel capable of conveying carrier fluid and droplets;

a plurality of voltage adjustable input terminals substitutable by electronic circuit(s);

an electronic component or channel comprising a plurality of electrodes operable with the carrier fluid in the channel, the electronic component or channel comprising an impedance selected from the group consisting of resistor, inductance and capacitor;

an output signal circuit;

a controlling component or feedback component having a first end connected to the output signal circuit, and a second end connected to a controllable device selected from the group consisting of a pump and a valve;

the one or more hybrid dividers is configured to act as a hybrid copier, hybrid computer, encoder, decoder, multiplexer, or other logic device; and a first conductor electrically connecting one of the electrodes with the impedance, wherein at least two of the electrodes form opposing electrodes about the carrier fluid in the channel, wherein the encoder converts fluid information from one format to another, wherein the decoder performs the reverse functions of an encoder, and wherein the logic gates comprise two XOR gates for a 4-to-2 line encoder;

one NOR gate, one B-\->A gate, one A-\->B gate, and a AND gate for a 2-to-4 line decoder; and one OR gate, one B.fwdarw.A gate, one A.fwdarw.B gate, and a NAND gate for a 2-to-4 line invert decoder.

31. A hybrid rheostat/divider comprising:

a channel capable of conveying carrier fluid and droplets;

a plurality of voltage adjustable input terminals substitutable by electronic circuit(s);

an electronic component or channel comprising a plurality of electrodes operable with the carrier fluid in the channel, the electronic component or channel comprising an impedance selected from the group consisting of resistor, inductance and capacitor;

an output signal circuit;

a controlling component or feedback component having a first end connected to the output signal circuit, and a second end connected to a controllable device selected from the group consisting of a pump and a valve;

a first conductor electrically connecting one of the electrodes with the impedance; and a plurality of information input/output, including digital information 0 and 1, chemical components, volume of the droplet, kinetics of fluid flow, concentration of a certain chemical, color of the fluid, optical properties of the fluid, and the temperature of the fluid, wherein at least two of the electrodes form opposing electrodes about the carrier fluid in the channel.

32. A droplet reaction system comprising:

a plurality of hybrid rheostat/dividers according to claim 31; and a droplet merge module.

33. An integrated processor comprising:

a plurality of hybrid rheostat/dividers according to claim 31, connected in series and parallel to achieve multipurpose tasks.

* * * * *